US007837410B2

(12) United States Patent
James et al.

(10) Patent No.: US 7,837,410 B2
(45) Date of Patent: Nov. 23, 2010

(54) BARGE TRANSPORTATION SYSTEM AND REFURBISHING SYSTEM AND METHOD OF TRANSPORTING AND REFURBISHING BARGES

(75) Inventors: Jeffrey L. James, Paducah, KY (US); William E. Crabtree, Paducah, KY (US)

(73) Assignee: James Marine, Inc., Paducah, KY (US)

( * ) Notice: Subject to any disclaimer, the term of this patent is extended or adjusted under 35 U.S.C. 154(b) by 821 days.

(21) Appl. No.: 11/588,641

(22) Filed: Oct. 27, 2006

(65) Prior Publication Data

US 2007/0098499 A1 May 3, 2007

Related U.S. Application Data

(60) Provisional application No. 60/730,788, filed on Oct. 27, 2005.

(51) Int. Cl.
*B63B 59/06* (2006.01)

(52) U.S. Cl. ..... 405/2; 114/222

(58) Field of Classification Search ..... 114/222; 405/114

See application file for complete search history.

(56) References Cited

U.S. PATENT DOCUMENTS 2,543,348 A * 2/1951 Briese ..... 114/222
3,390,657 A 7/1968 Schneider
3,548,541 A * 12/1970 Miller ..... 451/75
3,681,926 A * 8/1972 Thatcher et al. ..... 405/1
3,752,109 A * 8/1973 Seiple ..... 114/222
3,817,041 A * 6/1974 Pownall ..... 405/1
4,003,329 A 1/1977 Robinson
4,027,433 A * 6/1977 Hockett ..... 451/75
4,048,956 A * 9/1977 Estebanez et al. ..... 118/306
4,615,641 A 10/1986 Novay
4,641,996 A * 2/1987 Seal ..... 405/2
4,714,375 A * 12/1987 Stevenson et al. ..... 405/3
4,808,931 A * 2/1989 Ling ..... 324/444
5,185,183 A * 2/1993 Gonda et al. ..... 427/236
5,199,228 A * 4/1993 Beausoleil ..... 451/80
5,353,729 A * 10/1994 Goldbach et al. ..... 114/222
5,355,823 A * 10/1994 Goldbach et al. ..... 114/222
5,398,632 A * 3/1995 Goldbach et al. ..... 114/222
5,445,101 A * 8/1995 Koch ..... 114/222
5,695,388 A 12/1997 Lyras (Continued)

OTHER PUBLICATIONS

Oct. 2000 Engineer Update; Bottoms up! Innovative workers replate old barge, saving time & money; Article and Photos by Brenda Beasley, Memphis District; http://www.hq.usace.army.mil/cepa/ . . . .

(Continued)

*Primary Examiner*—Tara Mayo-Pinnock
(74) *Attorney, Agent, or Firm*—Polster Lieder Woodruff & Lucchesi, L.C.

(57) ABSTRACT

A refurbishing system for refurbishing a barge includes transport systems that pull the barge out of water and onto a shelf above water level, then pull the barge into a covered blast system and a covered coating system. A reclamation system receives spent abrasive media. The transport systems then move the refurbished barge back into the water. The transport systems move the barge without substantially tilting it or changing its orientation.

19 Claims, 18 Drawing Sheets

U.S. PATENT DOCUMENTS

| | | | | |
|---|---|---|---|---|
| 5,716,261 | A * | 2/1998 | Watkin | 451/92 |
| 5,807,168 | A * | 9/1998 | Goldbach | 451/75 |
| 5,823,291 | A * | 10/1998 | Goldbach | 182/141 |
| 5,988,093 | A * | 11/1999 | Ni | 114/222 |
| 6,102,157 | A * | 8/2000 | Goldbach et al. | 182/128 |
| 6,173,669 | B1 * | 1/2001 | Staerzl | 114/222 |
| 6,186,273 | B1 * | 2/2001 | Goldbach et al. | 182/128 |
| 6,260,499 | B1 * | 7/2001 | Steel et al. | 114/222 |
| 6,276,292 | B1 * | 8/2001 | Soulek | 114/222 |
| 6,327,991 | B1 * | 12/2001 | Eichert | 114/222 |
| 6,571,635 | B1 * | 6/2003 | Baltzersen et al. | 73/625 |
| 6,877,452 | B1 * | 4/2005 | Hudd | 114/222 |
| 7,013,821 | B2 * | 3/2006 | Sakurai | 114/222 |
| H002159 | H * | 7/2006 | McGoldrick | 118/305 |
| 7,444,952 | B1 * | 11/2008 | McGann | 114/222 |
| 2004/0121181 | A1 * | 6/2004 | Call | 428/659 |

OTHER PUBLICATIONS

PCT Notification Concerning Transmittal of International Preliminary Report on Patentability (Chapter 1 of the Patent Cooperation Treaty) for corresponding International Application No. PCT/US2006/041710.

International Search Report and Written Opinion of the International Search Authority for PCT Application No. PCT/US06/41710.

* cited by examiner

BARGE TRANSPORTATION SYSTEM AND REFURBISHING SYSTEM AND METHOD OF TRANSPORTING AND REFURBISHING BARGES

CROSS-REFERENCE TO RELATED APPLICATIONS

This application claims priority under 35 U.S.C. §119(e) of U.S. Provisional Patent Application No. 60/730,788 filed Oct. 27, 2005, in the name of the present inventors and entitled "River Barge Refurbishment System And Method Of Refurbishing River Barges", this provisional application being incorporated herein by reference.

STATEMENT REGARDING FEDERALLY SPONSORED RESEARCH

Not Applicable.

BACKGROUND OF THE INVENTION

The present invention relates to a system for processing barges. The present invention has particular utility with respect to transporting and refurbishing unpowered river barges. As used herein, the term "river barge" means a barge adapted for use on an inland waterway, including an intracoastal waterway.

River barges are large, having a length of about 100-450 feet (about 30 to about 135 meters), a width of about 30-75 feet (about 9 to about 23 meters), and a depth of about 8-30 feet (about 2.5 to about 9 meters). Most river barges in the United States come in two sizes, standard or jumbo. A standard river barge has a hull which is 195 feet (59 meters) long, 35 feet (10.7 meters) wide, and 10-14 feet (3 to 4.3 meters) deep. The hull thickness for a standard barge is approximately ⅜ inch-½ inch (about 0.95 to about 1.25 cm). A jumbo river barge typically has a hull 297 feet (90.5 meters) long, 54 feet (16.5 meters) wide, and 12 feet (3.7 meters) deep. The thickness of the sides and bottom varies according to construction specifications of a particular barge. Based on construction differences, all these sizes may vary by ±5%. The standard river barge has a typical unfilled weight of 300 U.S. tons (272,000 kg). The jumbo river barge has a typical unfilled weight of 1,000 U.S. tons (907,000 kg).

River barges are typically generally rectangular as viewed in plan, with a length greater than their width. Their hulls are generally flat-bottomed, and one or both ends may be square (box hull) or sloped (rake hull). They may have internal structures and superstructures adapted for carrying particular types of cargo, and may be classified, for example, as a hopper barge, a tank barge, or a deck barge. A hopper barge typically has a coaming of from eighteen inches to six feet in height. A cover, such as a fiberglass cover or steel cover may be provided to secure the cargo hopper from the elements, may be provided over the coaming.

The exterior surfaces of river barges are sometimes painted to protect them from corrosion. Over time, however, the exterior surface, and in particular the hull, of the barge begins to corrode because of contact with the water and the atmospheric environment. To refurbish these barges, a typical process comprises manual sand blasting and manual spray-painting the barge surfaces. The current methods for blasting and painting are either performed on a dry-dock or on marine ways. In a dry-dock, water is drained, the barge is manually blasted with abrasive, as much abrasive is cleaned up as can easily be accomplished, the barge is painted manually, the barge is floated over sufficiently that when water is again drained the spots where it was supported can be recoated.

In one marine ways process, the barge is partially pulled from an inland waterway and the surface is processed (sand blasted and painted) on the landside surface and on as much as the stern and bow of the barge as accessible. As such, this current process may still position part of the barge within the waterway. After the paint has dried, the barge is lowered back into the waterway and shifted around by a boat so that the other side can be exposed when pulled from the waterway. This manipulation of the barge on a flowing river or in a confined bay is extremely difficult and labor intensive. Once pulled from the waterway, this exposed side is blasted and painted to match the other processed side of the barge. Besides being inefficient with respect to processing only one side of the exterior surface of the barge at a time, these sandblasting and painting processes result in spent materials falling on the ground and being exposed to the waterway. An alternative marine ways process is to pull the barge up level, sufficiently far from the waterway to erect scaffolding, and the barge is processed from the embankment and from the scaffolding. Again, spent materials are largely exposed to the ground and to the waterway. The inefficiencies and hazardous environmental conditions produced by all these methods are further exacerbated by the size of the jumbo barges. The current methods are extremely expensive and very few environmental controls can be incorporated into the processes.

SUMMARY OF THE INVENTION

The present invention provides methods for refurbishing barges efficiently and, in accordance with certain preferred embodiments, with little environmental contamination, and systems for carrying out the methods. In view of the following invention, various novel features of the methods and systems will be apparent to those skilled in the art and are set out in the appended claims.

BRIEF DESCRIPTION OF THE SEVERAL VIEWS OF THE DRAWINGS

In the accompanying drawings which form part of the specification.

Corresponding reference characters indicate corresponding parts throughout the several views of the drawings.

DESCRIPTION OF THE PREFERRED EMBODIMENTS

Figure 1:
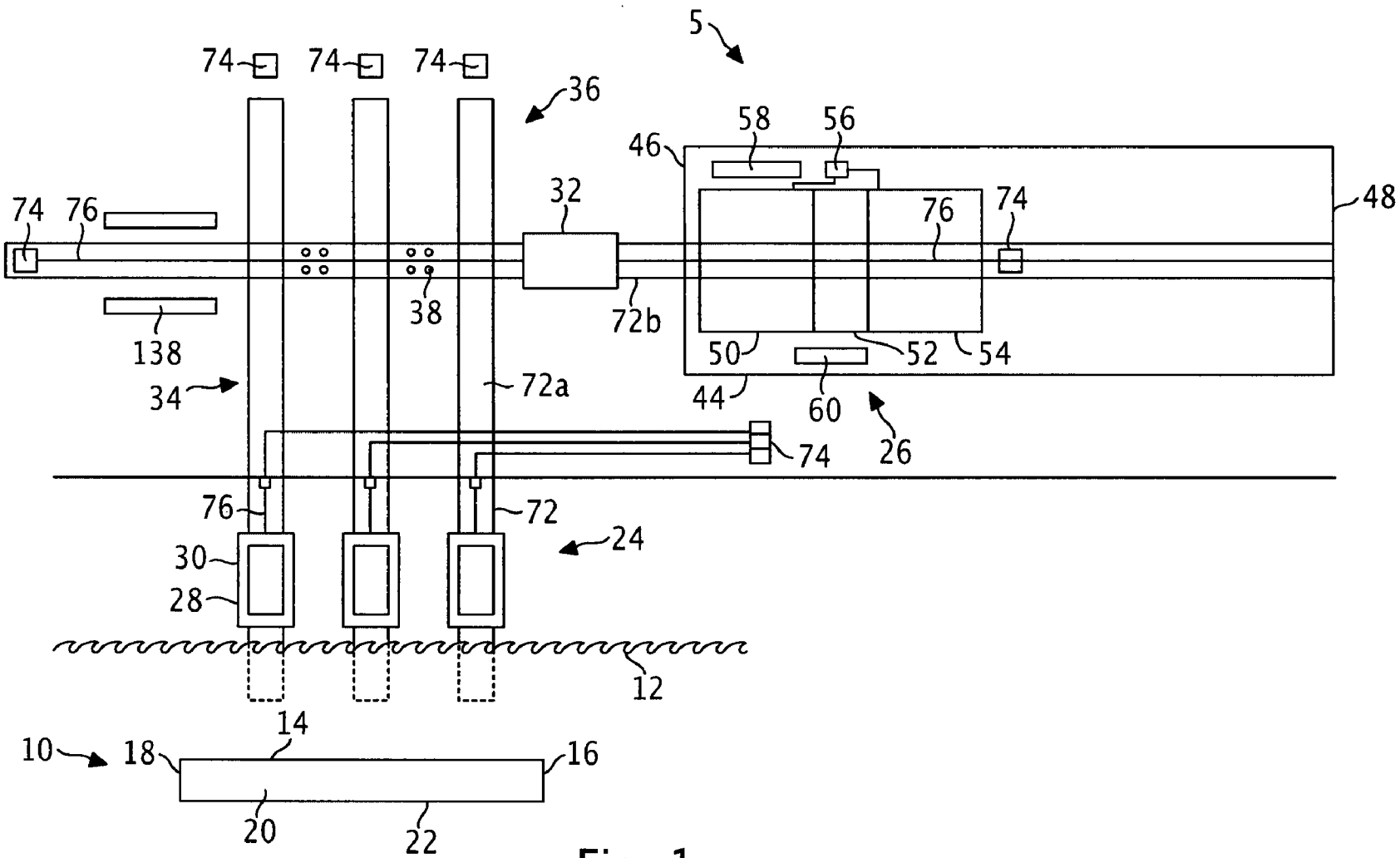
FIG. 1 is a schematic of systems, constructed in accordance with and embodying the present invention, illustrating a barge, a transportation system and a refurbishing system, the refurbishing system having a blast system and having a coating system.

The following detailed description illustrates the invention by way of example and not by way of limitation. The description clearly enables one skilled in the art to make and use the invention, and describes several embodiments, adaptations, variations, alternatives, and uses of the invention, including what is presently believed to be the best mode of carrying out the invention.

The first illustrative embodiment of the present invention transports barges completely out of a waterway and into a covered refurbishing system that is positioned on land. Within the covered refurbishing system, the hull of the barge is abrasively blasted and then coated. Once the barge has been refurbished, the system transports the barge back into the waterway. The system eliminates or greatly reduces contamination of the ground and/or of the waterway from discharged blast material and/or coating overspray since the refurbishing system collects the discharged blast material and/or coating overspray. The system further permits much faster refurbishment of barges by treating more than one exterior surface at a time. For illustrative purposes, the following description relates to an unpowered river barge.

Referring to the drawings, the processing system 5 (FIG. 1) is schematically shown. A barge 10, which is unpowered and floats free unless acted upon, is pushed by a towboat or tugboat (not shown) within a waterway 12. The waterway 12 may comprise any water source such as, but not limited to, a river, a lake, a channel (natural or artificial) and a bay/cove (natural or artificial). The waterway 12 may also comprise a lock system (not shown), the dimensions of which may determine the practical dimensions of the barge. Regardless of the type of waterway 12, the barge 10 reaches an access point for processing. In an illustrative embodiment of the present invention, the barge 10 is a standard sized barge 10 that has a hull having a length of 195 feet (59 meters), a width of 35 feet (10.7 meters), a height of 10-14 feet (3-4.3 meters), all dimensions being ±5%. The weight of such a barge is about 300 U.S. tons (about 250,000 kg to about 300,000 kg). As known, the barge 10 includes sides 14, a bow 16, a stern 18 and a bottom 20. These portions of the barge 10 are collectively known as the hull. The exterior surface of the hull is designated by reference numeral 22.

Turning to FIGS. 1-16, the processing system 5 of the present invention comprises a transportation system generally shown as 24 and a refurbishing system generally shown as 26. The transportation system 24 comprises a first transport system 28, a second transport system 30, a third transport system 32, a rail system generally shown as 34, a drive system generally shown as 36 and a lift system generally shown as 38. FIG. 1 schematically illustrates the systems of the transportation system 24.

The refurbishing system 26 comprises a housing 44 having a first end 46 and a second end 48, a blast system 50, a transition system 52 and a coating system 54. The housing 44 may be in the form of a building. In this illustrative embodiment, the housing 44 has a length of 325 feet (99 meters). The housing 44 covers the blast system 50, the transition system 52 and the coating system 54 to substantially isolate these areas from the outdoor environment while the first end 46 allows access within the housing 44. The second end 48 is preferably closed but may be open to allow access within the housing 48. The refurbishing system 26 also comprises a control system 56, a reclamation system 58 and a filter system 60. FIG. 1 schematically illustrates the systems of the refurbishing system 26.

Figure 3:
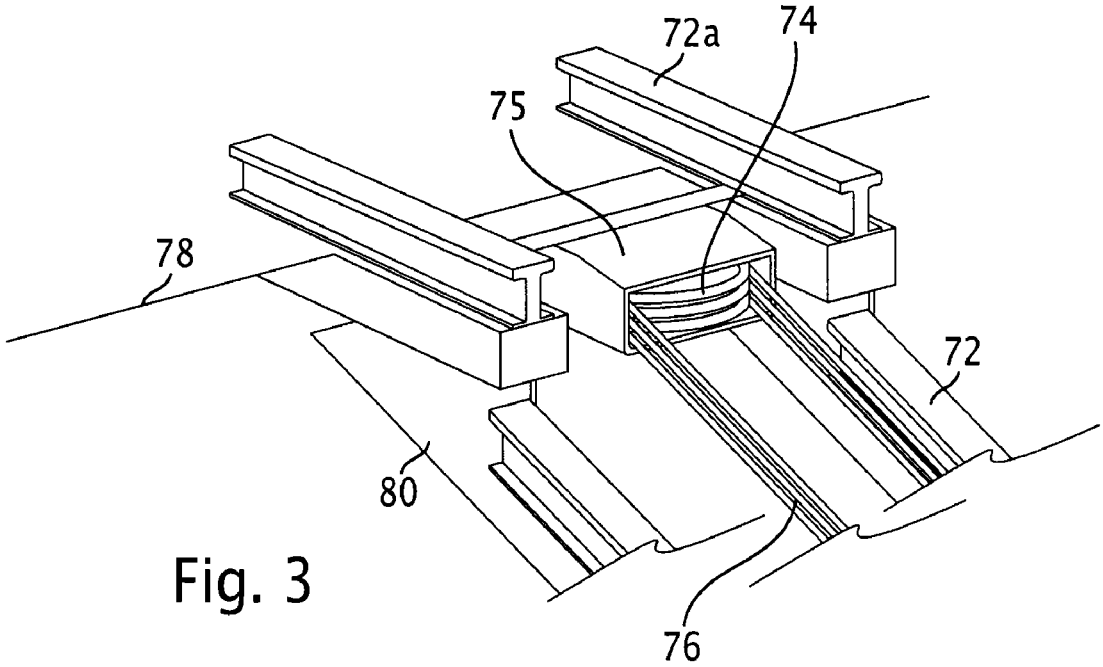
FIG. 3 is a partial isometric view of a sheave block and rails of the transportation system.
Figure 4:
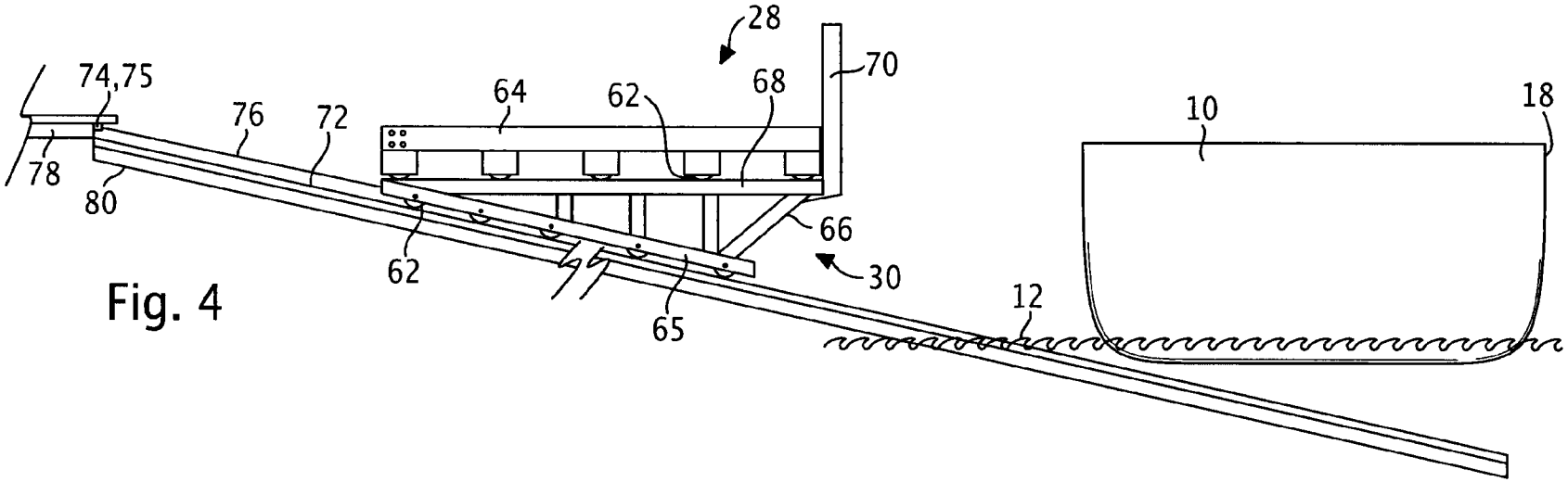
FIG. 4 is a side elevational view of an embodiment of a first transport system connected to a second transport system, the connected first transport system and the second transport system moving toward the barge which is positioned in a waterway.

Turning to FIGS. 3-9, the first transport system 28, the second transport system 30 and the third transport system 32 comprise dollies comprising frames connected to casters or wheels 62. As shown in FIG. 4, the illustrative first transport system 28 comprises a rectangular base assembly 64 connected to the wheels 62. The second transport system 30 also includes a base assembly 65 connected to wheels 62. The second transport system 30 further includes an angle assembly 66, a support assembly 68 in the form of a pair of rails, and a stabilizer 70 in the form of a docking pole. The angle assembly 66 positions the support assembly 68 in a level orientation Still referring to FIG. 4, the rail system 34 comprises rails 72 that support the wheels 62 of the second transport system 30, rails 72*a* (FIG. 3) that support the first transport system 28 when it rolls off the rails 72 of the second transport system 30, as described hereinafter, and rails 72*b* that support the wheels 62 of the third transport system 32 (FIGS. 1, 8*b*). The drive system 36, in turn, moves the first transport system 28, the second transport system 30 and the third transport system 32 along the rails 72, 72*a*, and 72*b* as described hereinafter. The drive system 36 comprises a plurality of motor-driven winches 74, sheave blocks and cables 76 that connect with the transport systems or the barge carried by them, and move them. The rail system 34 and drive system 36 have sufficient parameters to move and transfer the barges 10. For example, the winches 74 may comprise a 60-ton wide body winch that is driven by a vector computer regenerative drive to produce variable speed. The cables 76 are one-inch steel. The motor horsepower on the winches 74 is 18 horsepower through a 16 to 1 gearbox.

As shown, for example, in FIG. 4, the rails 72 support the second transport system 30 while cable 76 of the drive system 36 connects the motor-driven winch 74 with the second transport system 30 via sheave block 75. The winch 74 is shown schematically connected to sheave block 75 in FIGS. 3-6. As shown in FIG. 1, the winch 74 that drives the second transport system 30 is preferably positioned adjacent to the housing 44. Additionally, as shown in FIG. 4, the first transport system 28 is carried by the second transport system 30 and connects with the second transport system 30 via fastening means such as linkages or pins. The angle assembly 66 of the second transport system 30 positions the support assembly 68, hence the first transport system 28, horizontally.

Figure 5:
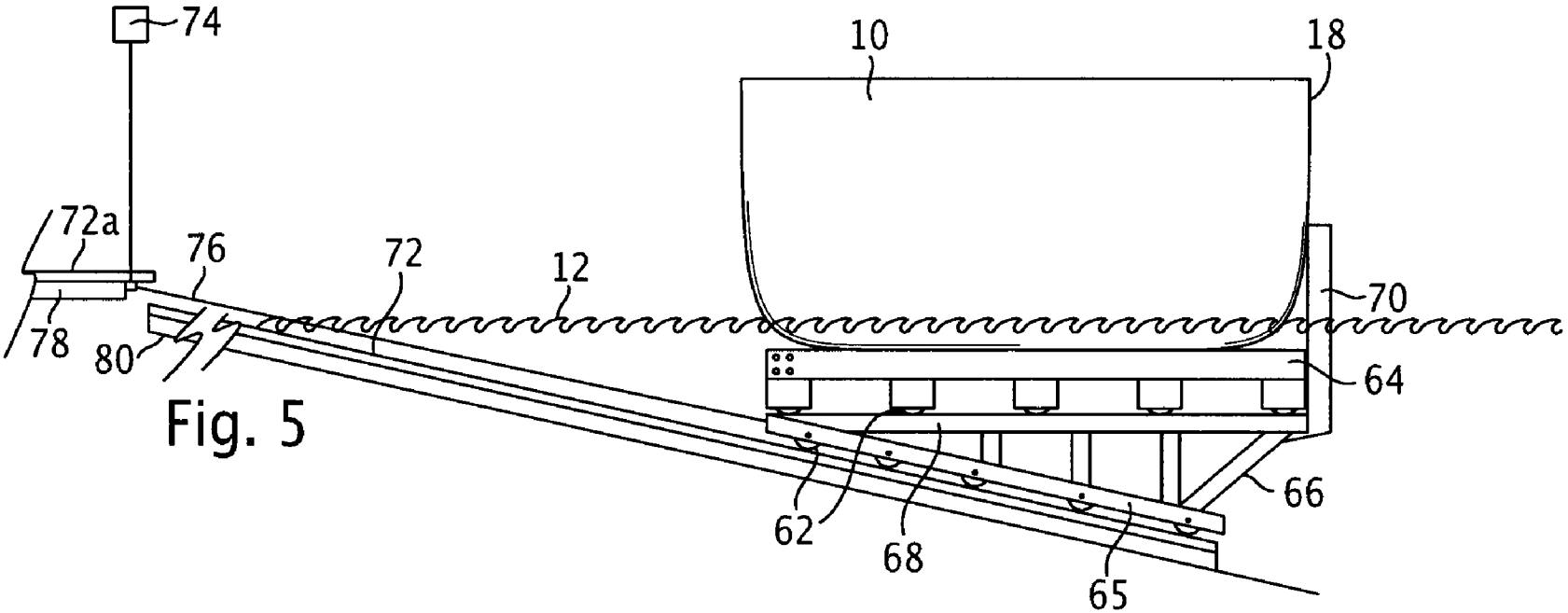
FIG. 5 is a side elevation view of the second transport system and the connected first transport system in an underwater position illustrating the barge floating into contact with the first transport system.
Figure 6:
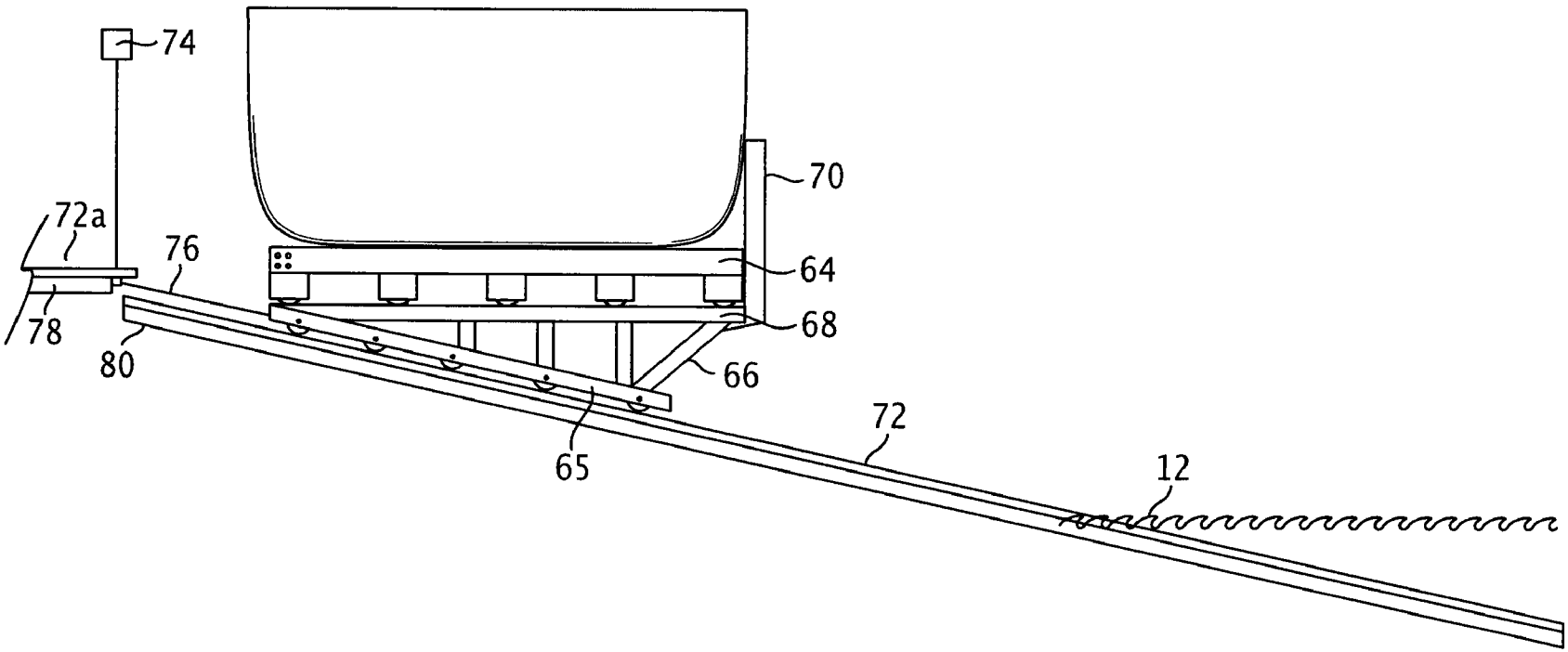
FIG. 6 is a side elevational view of FIG. 4 illustrating the barge supported by the first transport system and the second transport system and the supported barge, the connected first transport system and the second transport system moving away from the waterway and toward a position away from the waterway.

Turning to FIG. 5, the first transport system 28 and the second transport system 30 move underwater such that the barge 10 floats (or is pushed by a tugboat) onto the top of the first transport system 28. The stabilizer 70 supports the barge 10 as the combined first and second transport systems 28, 30 are pulled toward shore. The tow or tug boat may also move the barge 10 toward shore until the barge 10 rests on the base assembly 64 of the first transportation system 28. The first transport system 28 and the second transport system 30 then move the barge 10 from the waterway 12 onto a berth, shelf, or island 78 (FIG. 6).

The berth 78 has a height that is taller than any predicted flood level such as a one hundred year level. An embankment 80 (FIG. 6) exists between the inland waterway 12 and the berth 78. The slope of the embankment 80 is 5 to 1 while rails 72 extend into the waterway 12 approximately 200 feet on a 5 to 1 slope. In one embodiment, the embankment 80 has a grade range of approximately 5 degrees to approximately 15 degrees. Further, in one embodiment, the embankment 80 has a height range of approximately 20 feet to approximately 40 feet (approximately 6-12 meters) above a normal level of the waterway 12. The angle assembly 66 of the second transport system 30 compensates for the grade of the embankment 80. While the first transport system 28 and the second transport system 30 move the barge 10 up the embankment 80, the configuration of the angle assembly 66 raises the barge 10 in a level orientation.

Figure 7:
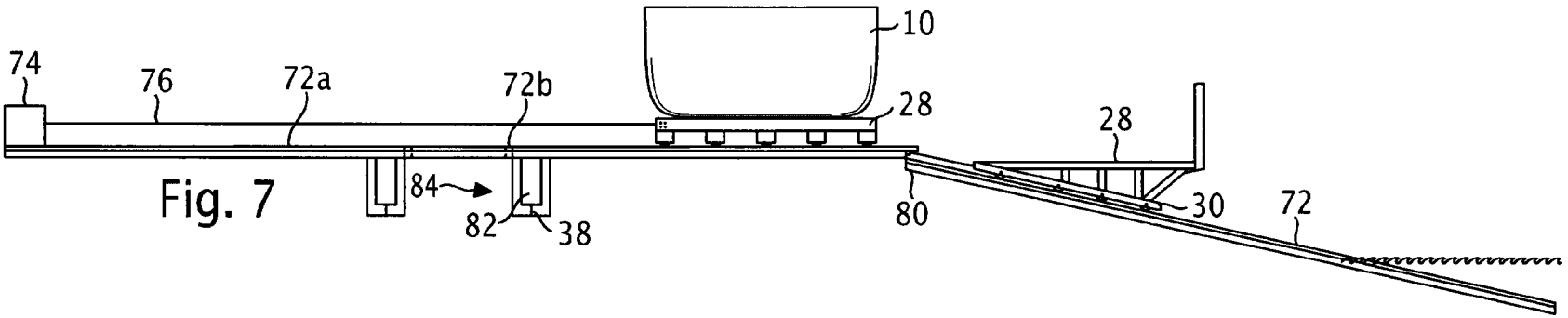
FIG. 7 is a side elevational view of the first transport system disconnected from the second transport while moving the barge to another inland position with the transportation system.
Figure 8A:
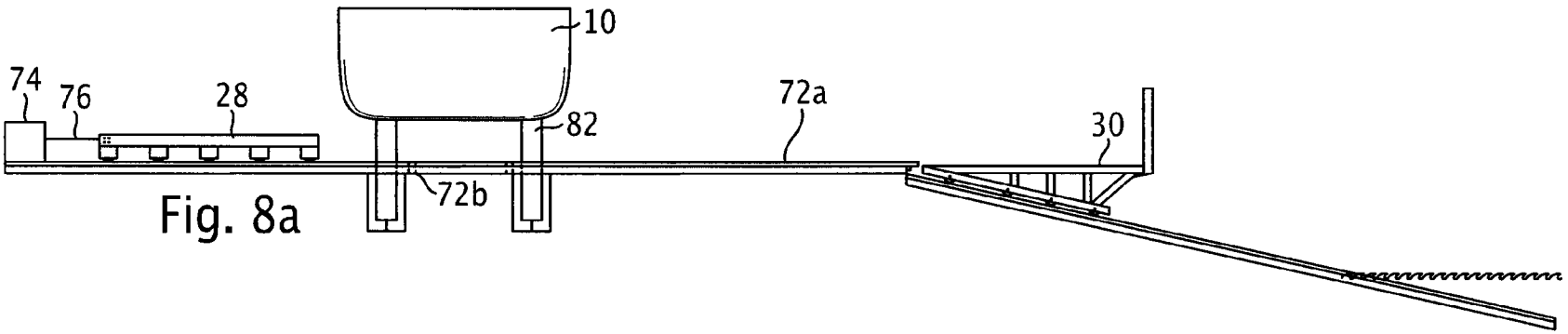
FIG. 8*a* is a side elevational view of a lift system supporting the barge in a raised position.
Figure 8B:
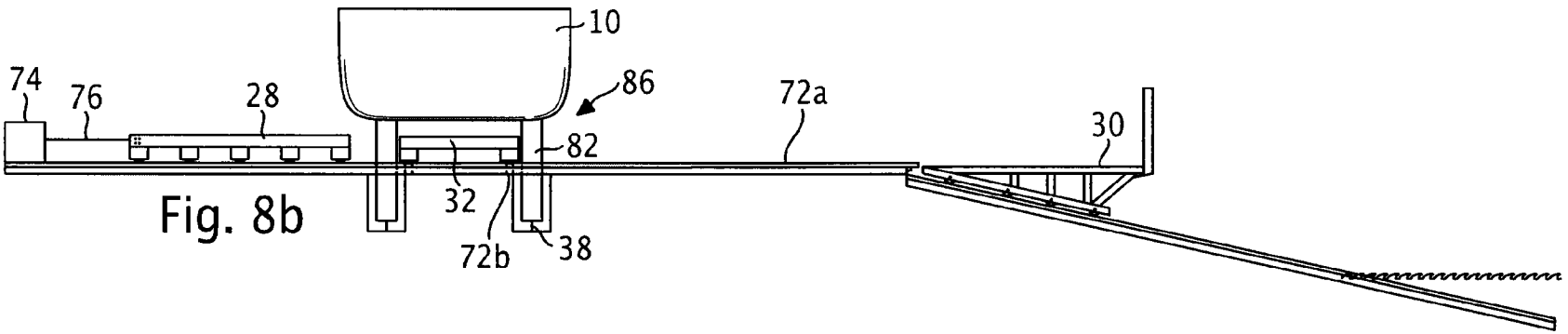
FIG. 8*b* is a side elevational view of a lift system contacting and raising the barge to provide clearance under the barge for contact with a third transport system.
Figure 9:
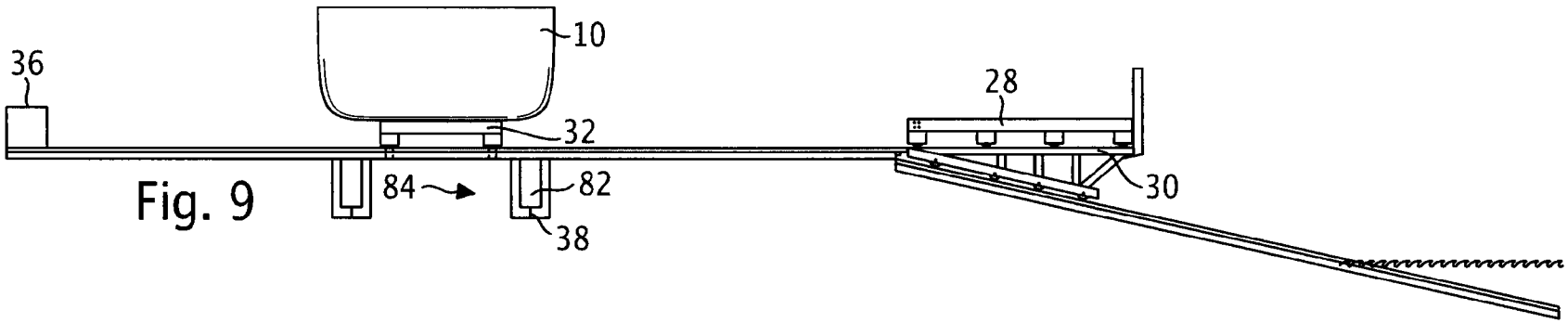
FIG. 9 is a side elevational view of the third transport system of FIG. 8 supporting the barge and the lift system in a retracted position and illustrating the first transport system reconnected with the second transport system moving toward the waterway.

Turning to FIGS. 7-9, at the top of the embankment 80, the wheels 62 of the first transport system 28 contact rails 72*a* of the rail system 34 positioned on the berth 78. Cable 76 connects the first transport system 28 with another winch 74 that is positioned on an inland position. In one embodiment, cable 76 connects with an internal sheave block of the first transport system 28. Winch 74 then moves the first transport system 28 across the berth 78 and over the lift system 38.

Figure 9B:
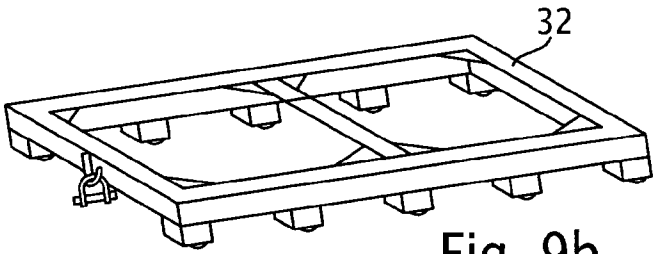
FIG. 9*b* is an isometric view of the third transport system.
Figure 9A:
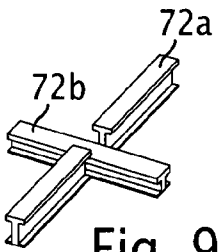
FIG. 9*a* is an isometric view of a switch rail assembly.
Figure 10:
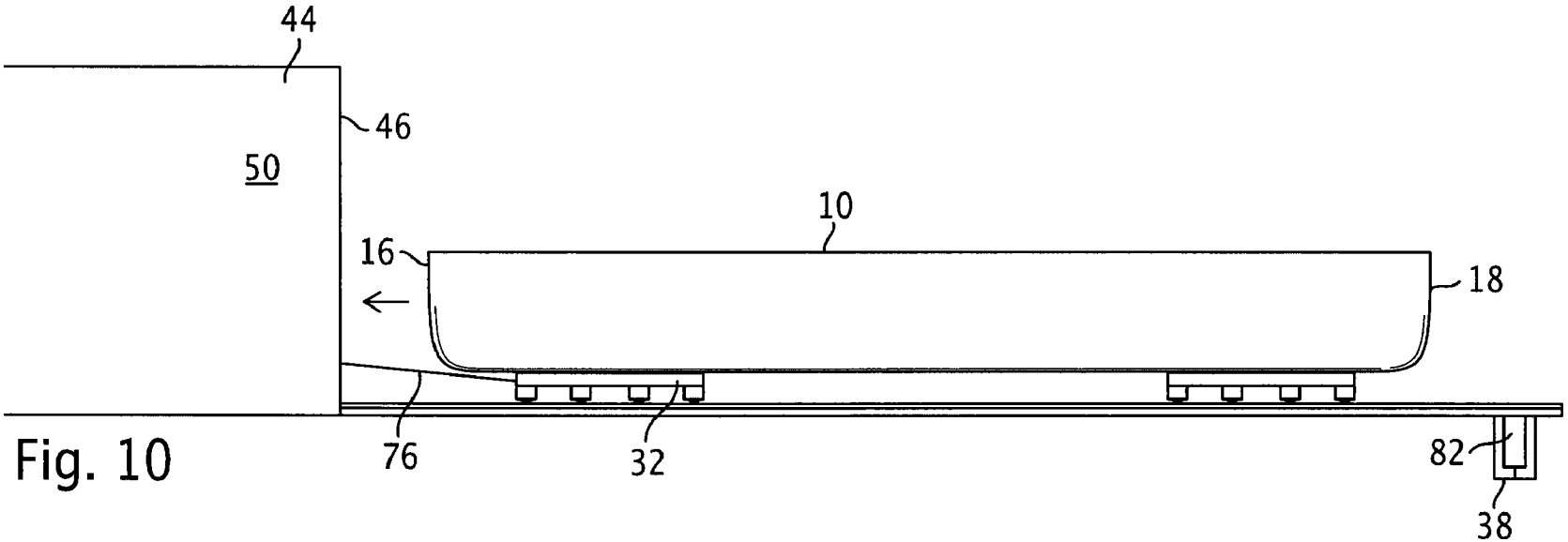
FIG. 10 is a side elevational view of the third transport system moving the barge away from the other position and toward the refurbishing system of FIGS. 1 and 2.
Figure 11:
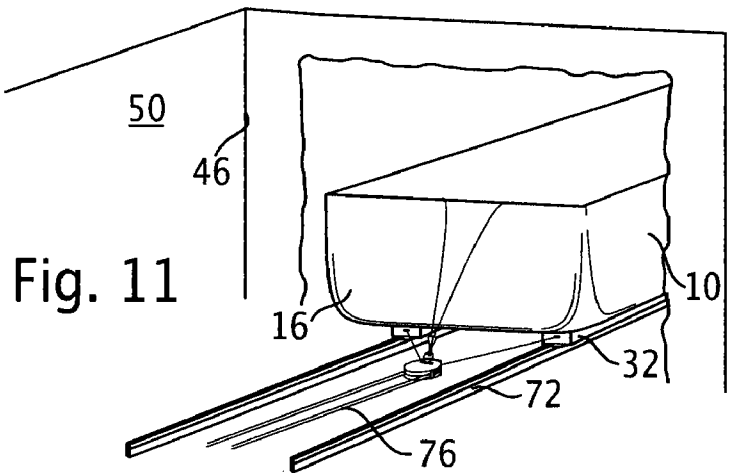
FIG. 11 is a perspective view of the third transport system moving the barge within a first end of the refurbishing system.

The lift system 38 of the transportation system 24 comprises jacks 82 or pylons that reciprocate between a retracted position 84 (FIG. 7) and an extended position 86 (FIGS. 8*a* and 8*b*). The jacks 82 may be hydraulically driven by known means. As will be discussed, in the extended position 86, the lift system 38 raises the barge 10 off the first transport system 28. Winch 74 then moves the first transport system 28 away from the barge 10 while another winch 74 (FIG. 1) moves the third transport system 32 along rails 72*b* under the barge 10 (FIG. 8*b*). In the retracted position 84, the lift system 38 lowers the barge 10 onto the third transport system 32 (FIG. 9). FIG. 9*a* illustrates the intersection of rails 72*a* and rails 72*b* with a portion of rail 72*a* removed wherein rails 72*a* have a larger height than rails 72*b*. FIG. 9*b* illustrates an embodiment of the third transport system 32. Once the third transport system 32 supports the barge 10, a winch moves the third transport system 32 and supported barge 10 into the housing 44 of the refurbishing system 26 (FIGS. 10 and 11).

Figure 2:
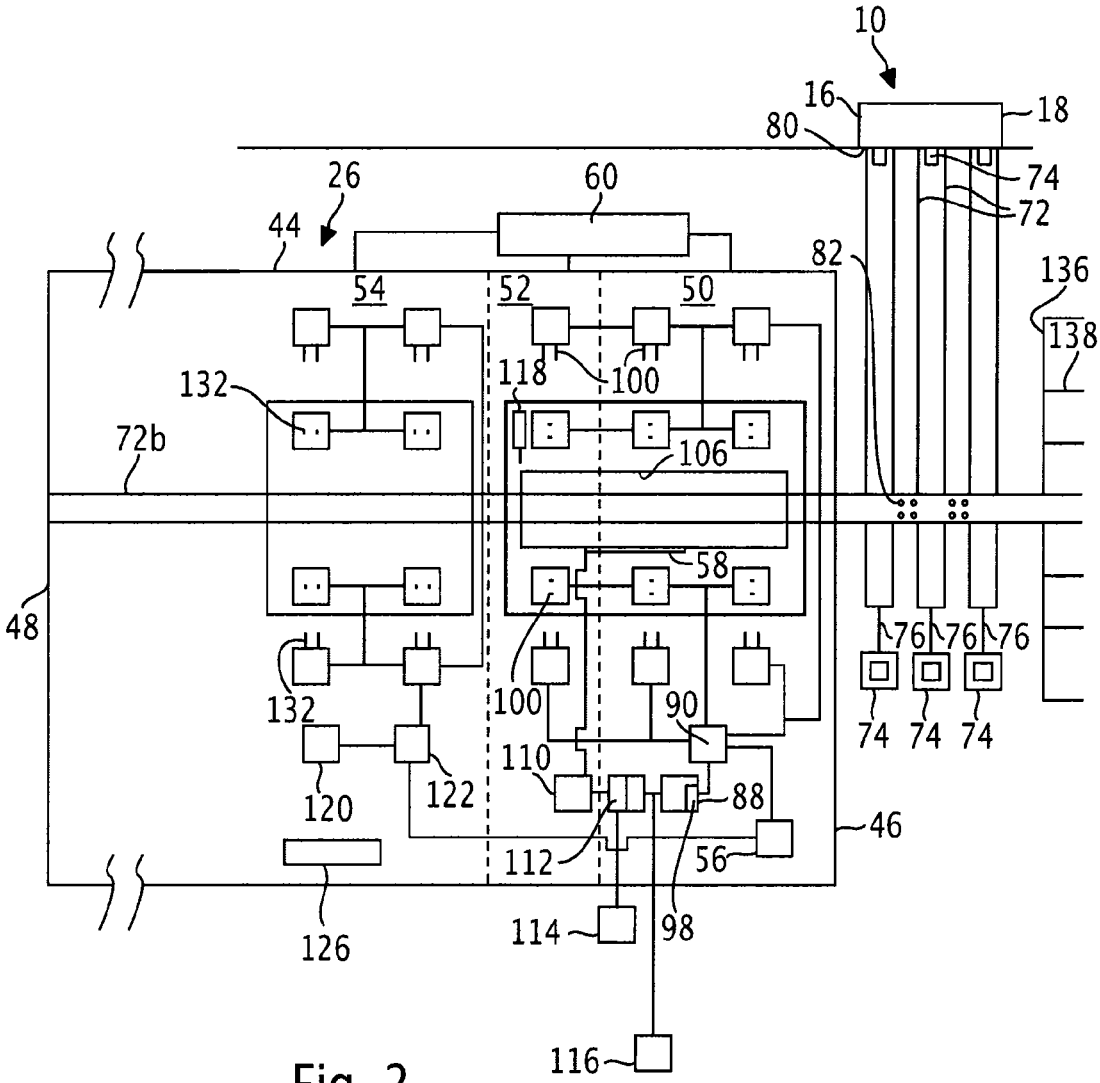
FIG. 2 is a schematic of the refurbishing system of FIG. 1, constructed in accordance with and embodying the present invention, illustrating a blast media discharge system, a manual coating discharge system, a reclamation system, a control system and a filter system.

Returning to FIGS. 1 and 2, the refurbishing system 26 positions the covered blast system 50, the covered transition system 52 and the covered coating system 54 within the housing 44 such that the covered blast system 50, the covered transition system 52 and the covered coating system 54 are in operative communication with each other. FIG. 2 further schematically illustrates the winches 74, cables 76, rails 72, 72*a* and 72*b*, and jacks 82 of the transportation system 24 positioned near the first end 46 of the housing 44. As shown in FIG. 1, the transportation system 24 is in communication with the covered blast system 50, the covered transition system 52 and the covered coating system 54.

Referring to FIG. 2, the covered blast system 50 comprises a blast storage tank 88, a blast media discharge system 90, and the reclamation system 58. The control system 56 operatively controls at least the blast storage tank 88, the blast media discharge system 90, and the transportation system 26. In the illustrative embodiment, the covered blast system 50 has a height of 24 feet (7.3 meters), a width of 50 feet (15.2 meters) and a length of 50 feet (15.2 meters). The covered blast system 50 may include other dimensions to accommodate a variety of sizes and configurations for barges 10.

Figure 12:
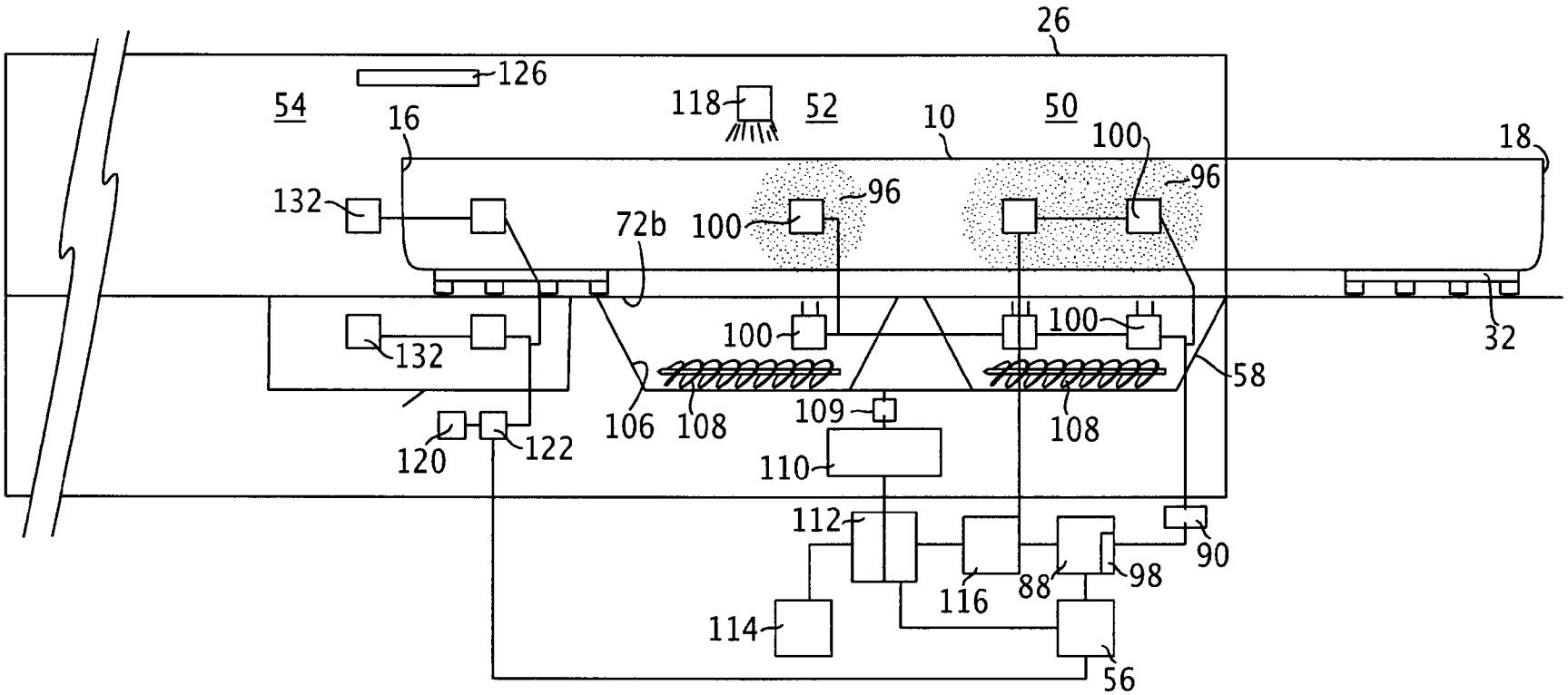
FIG. 12 is a partial schematic view of FIG. 2 of the blast media discharge system, the manual coating discharge system and associated components thereof.
Figure 13:
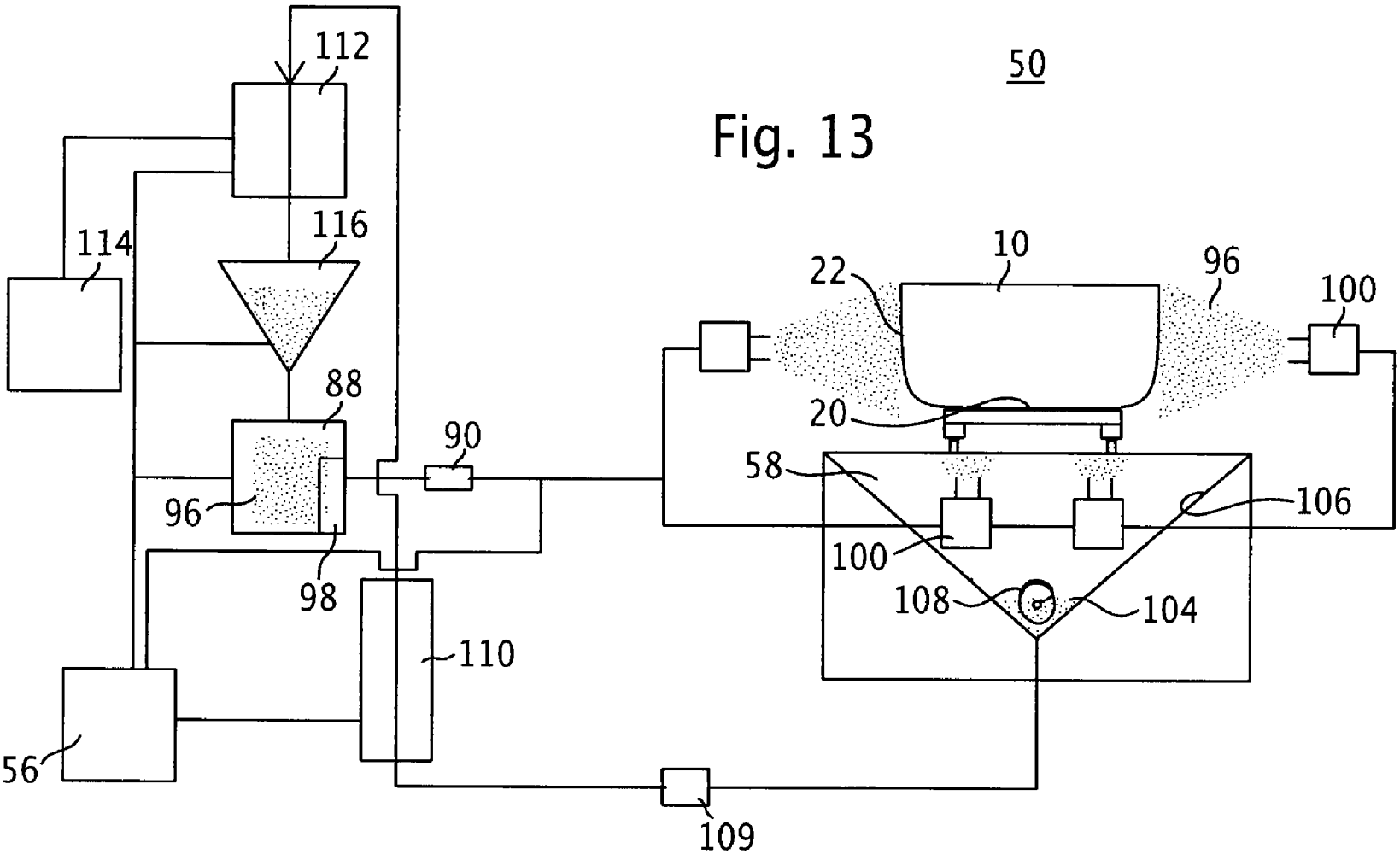
FIG. 13 is another schematic view of the blast media discharge system of FIG. 12 showing a blast storage tank, abrasive media, a plurality of blast discharge nozzles, the reclamation system, an elevator, a separator, a blast media waste disposal means, a hopper and a control system.
Figure 13A:
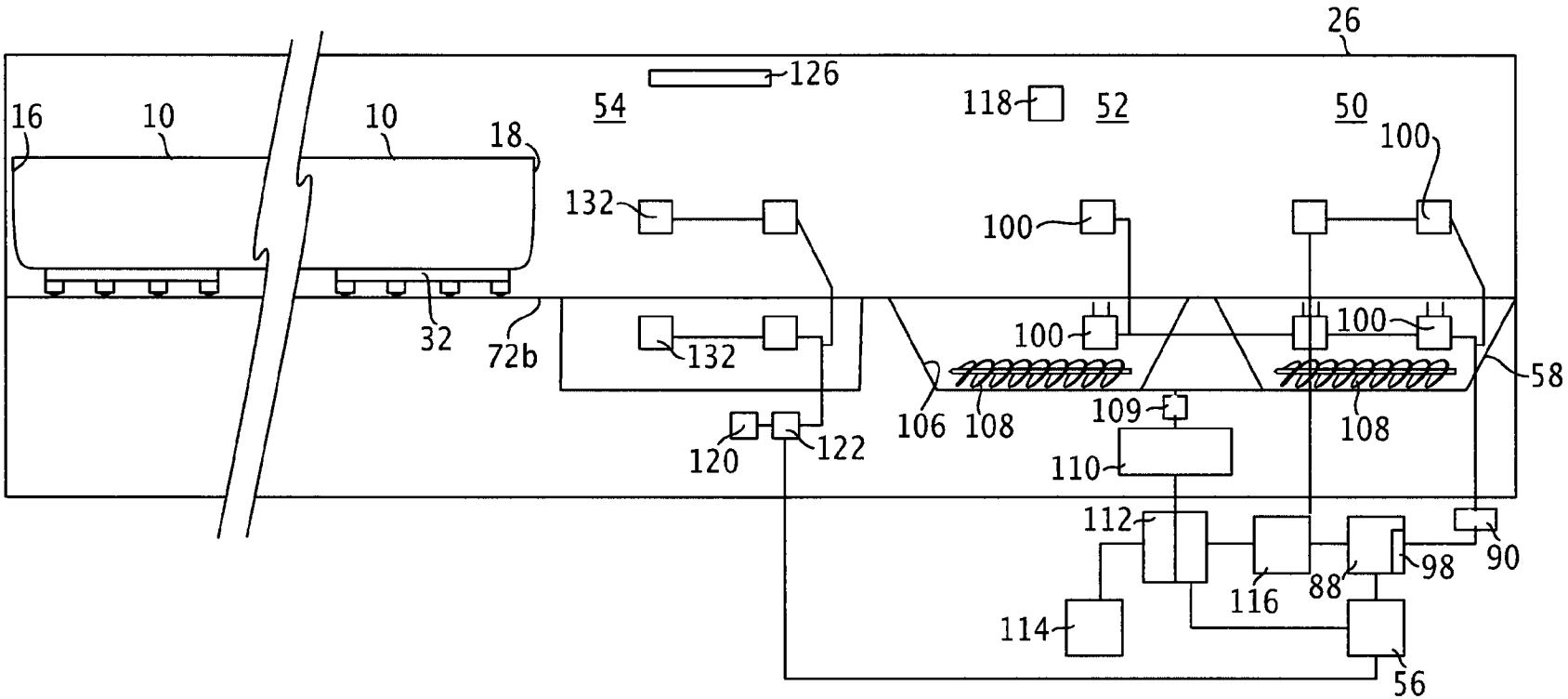
FIG. 13*a* is a schematic view of the barge positioned in a drying area of a housing containing the blast media discharge system and manual coating discharge system.

Turning to FIGS. 12, 13 and 13*a* and referring to FIG. 2, the blast storage tank 88 holds an amount of abrasive media 96. In one embodiment, the abrasive media 96 comprises steel grit. The blast media discharge system 90 communicates with the blast storage tank 88 via piping. The blast media discharge system 90 comprises an air compressor system 98 and a plurality of discharge nozzles 100 positioned on both sides of the rail system 34 and underneath the portions of the rail system 34 positioned within the blast system 50. Accordingly, the blast system 50 includes a basement in the form of a trough or pit 106 that is positioned under the rails 72*b*. The rails 72*b* are suspended via I-beam supports across the pit 106. The side discharge nozzles 100 are positioned within the covered blast system 50 at a height to face the barge 10. The side discharge nozzles 100 may be adjustably positioned with respect to the height within the covered blast system 50 to process a variety of sizes and configurations for barges 10. In one embodiment, the system comprises eleven discharge nozzles 100.

The compressor system 98 transfers the abrasive media 96 from the blast storage tank 88 through the piping and out of the discharge nozzles 100. The discharge nozzles 100 propel the abrasive media 96 against both sides and the underside of the exterior surface 22 of the barge 10. The discharge nozzles 100 automatically reciprocate back and forth at 45° angles. The distribution pattern of the abrasive media 96 overlaps so as to spray the exterior surface 22 of the barge 10. The plurality of discharge nozzles 100 is configured to uniformly distribute the abrasive media 96 against the exterior surface 22 of the barge 10 as the barge is pulled through the blast system 50 at a rate of about 200 feet per hour as controlled by the control system 56. Accordingly, the control system 56 controls the rate of movement of the barge 10.

As shown, the blast media discharge system 90 simultaneously processes both sides of the barge 10 while processing the bottom 20. The bow 16 and the stern 18 are processed as the barge 10 enters and exits the blast system 50, respectively. The blast media discharge system 90 may supply 6,000 cfm (170 cubic meters per minute), via air compressors, during the blasting process. The components of the blast media discharge system 90 such as the piping, fittings, valves and discharge nozzles 100 are all designed to withstand the flow rate of the abrasive media 96.

The reclamation system 58 is positioned underneath the portion of the rails 72*b* positioned within the covered blast system 50. The reclamation system 58 collects the applied abrasive media 96 and any blasted portions of the exterior surface 22 of the barge 10. Accordingly, a grated floor covers the reclamation system 58 such that the grated floor allows the discharged abrasive media 96 and blasted surface components 104 of the barge 10 to pass through and into the reclamation system 58. The grated floor allows personnel access to walk over pit 106. The blasted surface components 104 comprise debris, rust, corrosion, etc., removed from the exterior surface 22 by the discharged abrasive media 96. The reclamation system 58 comprises a means to collect the discharged abrasive media 96 and blasted surface components 104 of the exterior surface 22 of the barge 10. In one embodiment, the reclamation system 58 includes the pit 106, which channels the discharged abrasive media 96 and blasted surface components 104 to augers 108. The augers 108 of the reclamation system 58 move the discharged abrasive media 96 to a cross augur 109 that in turn moves the discharged abrasive media 96 to an elevator 110. The elevator 110, in turn, lifts the discharged abrasive media 96 and blasted surface components 104 for recycling.

The reclamation system 58 also includes a separator 112 that reclaims re-useable abrasive media 96 while discarding unusable abrasive media 96 from the transported media from the elevator 110. The separator 112 also discards blasted surface components 104. The separator 112 discards the waste abrasive media 96 and blasted surface components 104 to the media disposal means 114 such as a waste drum. The separator 112 then moves the reusable abrasive media 96 into a hopper 116 that feeds the blast discharge system 90 to repeat the blasting process. As shown, the control system 56 operatively controls at least the blast storage tank 88, the blast media discharge system 90, the discharge nozzles 100, and the transportation system 26.

The covered blast system 50 (FIG. 1 and 12) is covered to prohibit rain/snow/moisture from contacting the now prepared (i.e. blasted) exterior surface 22 of the barge 10. As such, the prepared barge 10 is not exposed to any outside environment that may oxidize the prepared exterior of the barge 10. Furthermore, the covered blast system 50 prohibits any rain/snow/moisture from contacting the discharged steel grit. Since the reclamation system 58 recycles the discharged steel grit of the abrasive media 96, the covered blast system 50 reduces oxidation of the steel grit.

Turning to FIG. 12 and referring to FIG. 2, the covered transition system 52 is positioned in between and in communication with the covered blast system 50 and the covered coating system 54. Since the transition system 52 is in communication with the blast system 50, the rail system 34 moves the now prepared barge 10 to the covered transition system 52. As such, the prepared barge 10 is not exposed to any outside environment while transferring to the transition system 52. The covered transition system 52 of this embodiment is much shorter than the length of the barge 10. Once a part of the exterior surface 22 has been abrasive blasted by the discharge nozzles 100, the rail system 34 moves the prepared portion of the barge 10 into the covered transition system 52 (FIGS. 2 and 12). Any abrasive blasting which did not adequately process the exterior surface 22 of the barge 10 is touched up in a manual processing system of the covered transition system 52.

The covered transition system 52 comprises the manual processing system that includes hand held discharge nozzles 100. These discharge nozzles 100 may be controlled and supplied by the blast media discharge system 90 of the covered blast system 50. Personnel handle these discharge nozzles 100 to abrasively blast the barge 10 in areas that the covered blast system 50 may have missed as the barge 10 continues moving through the covered transition system 52. The discharge nozzles 100 may be positioned on both sides of the rail system 34 and underneath the portion of the rails 72*b* that is positioned within the covered transition system 52. The manual transition system 52 includes augers 108 also in communication with the reclamation system 58 such that the reclamation system 58 can collect applied abrasive media 96 that has fallen through the grated floor of the manual transition system 52.

The covered transition system 52 also includes an air discharge system 118. The air discharge system 118 includes an air source, an air pump, nozzles and associated piping which connects the air source, the pump and the nozzles. The air discharge system 118 is configured to apply high pressure air to the prepared exterior surface 22 of the barge 10 in order to remove any abrasive media 96 adhered to the exterior surface 22 of the barge 10. In the covered transition system 52, workers further process the barge 10 as the barge 10 continuously moves through by spraying the exterior surface 22 with compressed air to remove abrasive media 96 adhered to the exterior surface 22 during the abrasive blasting of the exterior surface 22, and make whatever other repairs and preparation may be required.

Figure 14:
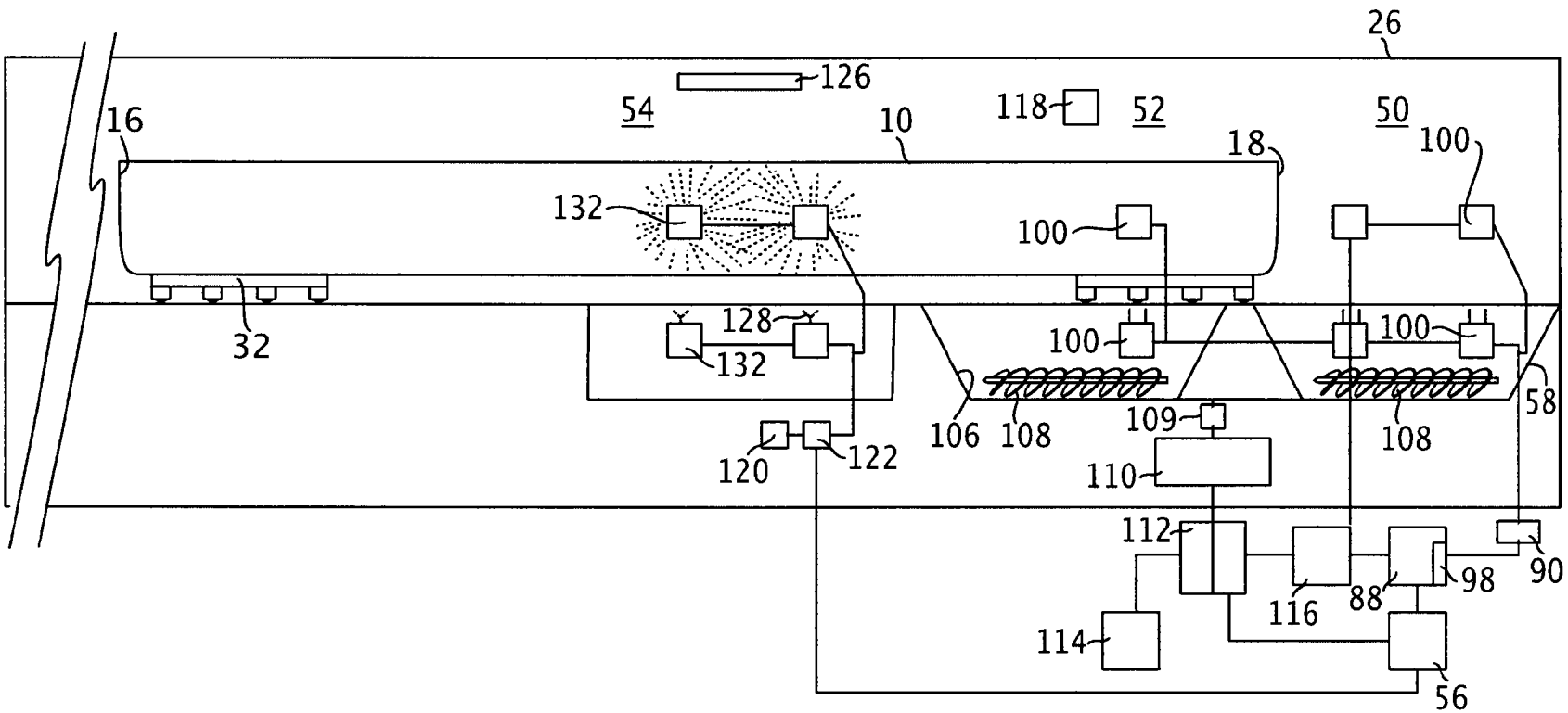
FIG. 14 is a schematic view of the barge moving through the coating system.
Figure 14A:
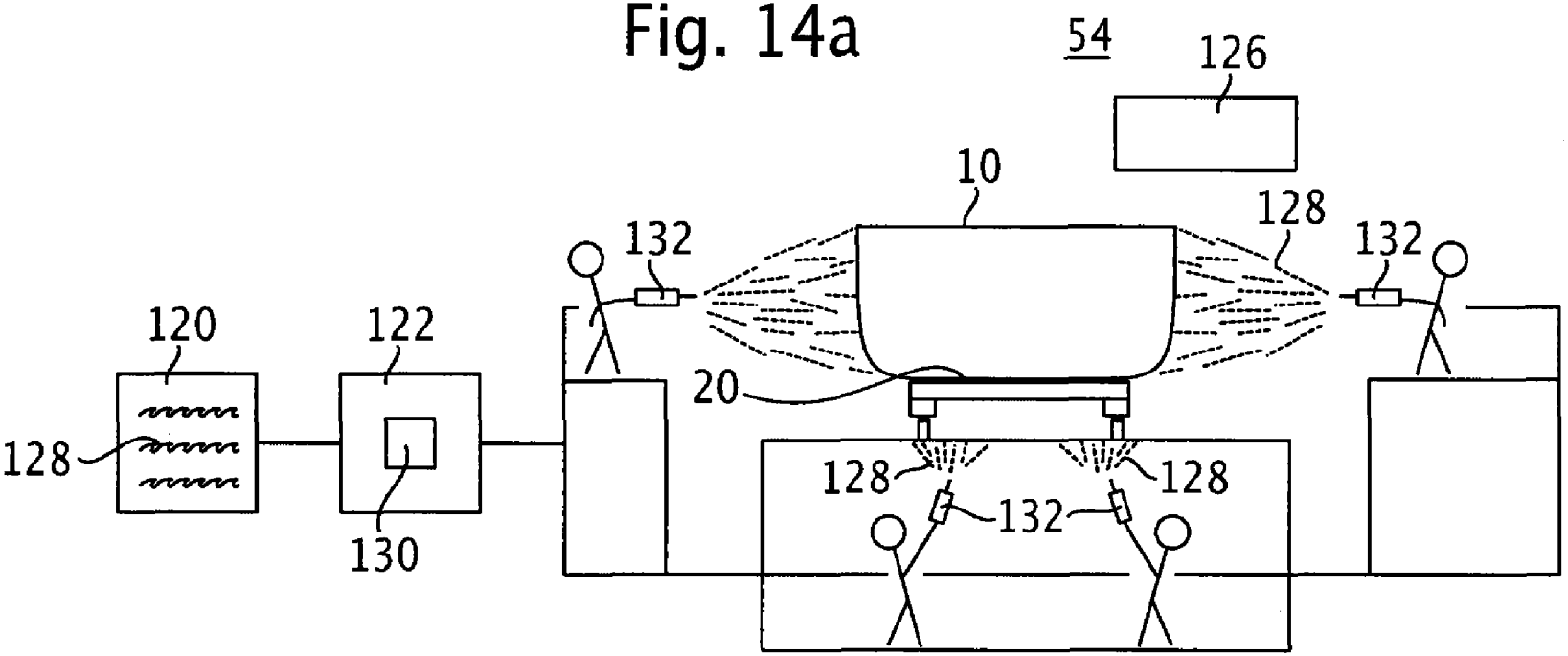
FIG. 14*a* is another schematic view of the coating discharge system of FIG. 12 showing a coating storage tank, a plurality of coating discharge nozzles, and painters applying a coating.

After air blowing the barge 10, the third transport system 32 then moves the prepared portion of barge 10 through the covered coating system 54. The drive system 36 pulls the barge 10 completely through the blast system 50 and the transition system 52. The drive system 36 then continues to pull the barge 10 past the unactivated coating system 54. The drive system 36 pulls the blasted barge 10 into the drying area of the housing 44 (FIG. 13*a*). Accordingly, the drive system 36 moves the prepared barge 10 from the transition system 52 and through the coating system 54 without exposing the barge 10 to any outside environments. Turning to FIGS. 14 and 14*a* and referring to FIG. 2, the drive system 36 moves the barge 10 back through the covered coating system 54. The coating system 54 comprises a coating storage tank 120, a coating discharge system 122, and a ventilation system 126. The coating system 54 may include automatic discharge of the coating and may include a coating reclamation system. In this illustrative embodiment, the dimensions of the coating system 54 include a height of 25 feet (7.6 meters), a width of 50 feet (15.2 meters) and a length 45 feet (13.7 meters). The covered blast system 50 may include other dimensions to accommodate a variety of sizes and configurations for barges 10. The pit 106 below the rails 72*b* and grated floor catwalks alongside the barge 10 give access to all parts of the barge hull.

The coating storage tank 120 holds an amount of the coating 128. In one embodiment, the coating 128 comprises a solvent-based paint or a two-component epoxy coating. The coating discharge system 122 communicates with the coating storage tank 120 via piping. The coating discharge system 122 comprises a compressor 130 and a plurality of coating nozzles 132 positioned on both sides of the rails 72*b* and underneath the portion of the rails 72*b* that is positioned within the covered coating system 54. The rails 72*b* suspend over pit 106 by I-beam support. The coating nozzles 132 are standard, manually operated airless paint guns that are connected by appropriate hoses to the coating discharge system 122 for use by painters. The compressor 130 transfers the coating 128 from the coating storage tank 120 through the piping and out of the coating nozzles 132. The painters spray the coating 128 against both sides of the exterior surface 22 of the barge 10 and the underside of the exterior surface 22 of the barge 10 as the barge 10 rolls through the coating system 54 at a speed of approximately 200 feet per hour (60 meters per hour). Accordingly, the control system 56 controls the speed of the barge 10 through the coating system 54. Additionally, the ventilation system 126 and filter system 60 properly handles any fumes created by the coating discharge system 122.

The coating system 54 is also covered to prohibit rain/snow/moisture from contacting the now coated exterior surface 22 of the barge 10. As such, the coated barge 10 is not exposed to the outside environment that may interfere with the drying or curing of the coating 128.

Referring still to FIGS. 1-16, the following descriptions will further detail the transporting steps and the processing steps applied to a river barge. During operation, the transportation system 24 lifts the unpowered river barge 10 from the inland waterway 12 and deposits the river barge 10 onto an inland position.

The transportation system 24 then moves the barge 10 into the refurbishing system 26 for processing. The blast system 50, transition system 52 and coating system 54 are in communication with each other to allow the transportation system 24 to move the barge 10 within the refurbishing system 26 under control of the control system 56. In this illustrative embodiment, a curtain C is provided at the front end 46 of the housing 44 (FIG. 11) to block the covered blast system 52 from the outside environment. The curtain is illustratively a physical curtain in the form of a shroud and provides a physical barrier, although an air curtain that creates a forced air barrier may also be used. Additionally, curtains C may be positioned to separate the blast system 50, the transition system 52, and the coating system 54.

In particular, the transportation system 24 moves the barge 10 out of and away from the waterway 12 (FIGS. 1-6). FIGS. 3-6 illustrate that moving the barge 10 out of and away from the waterway 12 comprises laterally moving the barge 10 with respect to the waterway 12. As shown, laterally moving the barge 10 with respect to the waterway 12 comprises moving the bow 16 and the stern 18 of the barge 10 substantially parallel to the waterway 12.

As shown in FIGS. 10 -12, the transportation system 24 then moves the barge 10 within the refurbishing system 26. Moving the barge 10 within the refurbishing system 26 comprises longitudinally moving the barge 10 with respect to the refurbishing system 26. As shown in FIGS. 10 and 11, longitudinally moving the barge 10 within the refurbishing system 26 comprises moving the barge 10 lengthwise within the refurbishing system 26. In other words, the bow 16 and the stern 18 of the barge 10 are substantially perpendicular with respect to the first end 46 of the refurbishing system 26.

Figure 15:
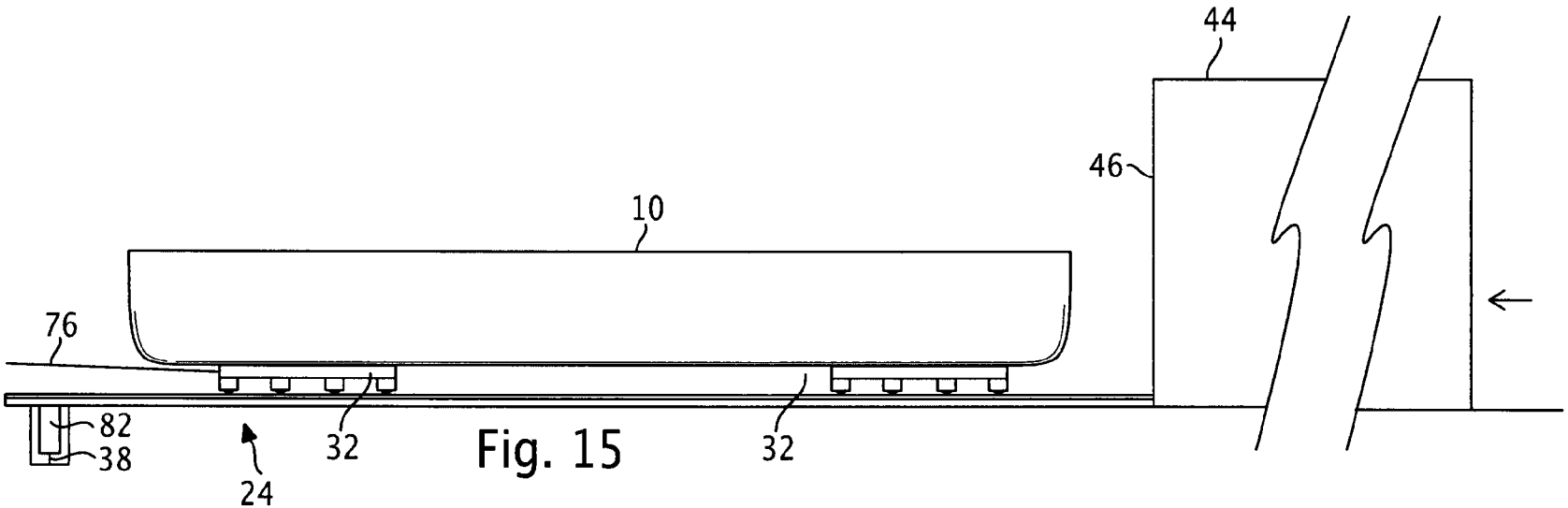
FIG. 15 is a side elevational view of the transportation system moving the processed barge out of the refurbishing system.
Figure 16:
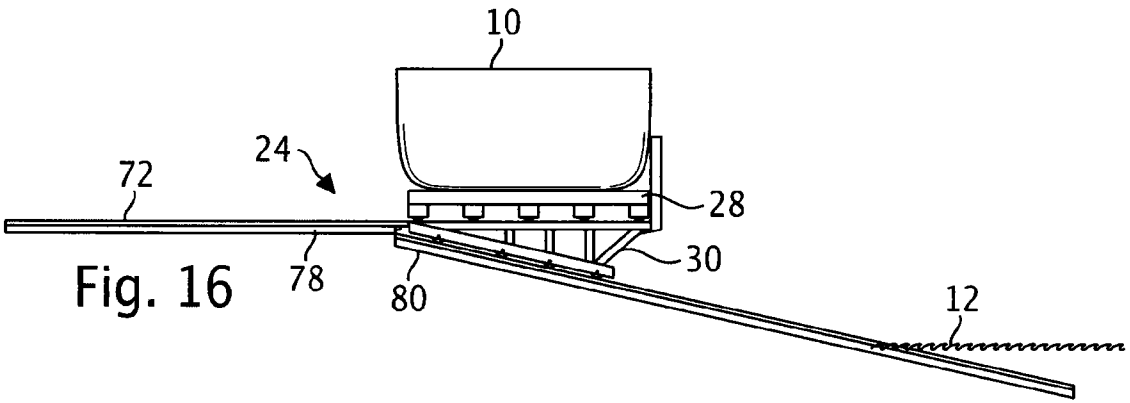
FIG. 16 is a side elevational view of the transportation system moving the processed barge toward the waterway.

After the refurbishing system 26 processes the barge 10, the transportation system 24 moves the barge 10 away from the refurbishing system 26. As shown in FIG. 15, the transportation system 24 longitudinally moves the barge 10 away from the first end 46 of the refurbishing system 26. Longitudinally moving the barge location away from the refurbishing system 26 comprises moving the barge 10 lengthwise from the first end 46. In other words, the bow 16 and the stern 18 are substantially perpendicular with the first end 46 of the refurbishing system 26. The lift system 38 transfers the barge 10 so that the transportation system 24 can move the barge 10 toward the waterway 12 (FIG. 16).

Since the embankment 80 positions the refurbishing system 26 inland from the waterway 12, moving the barge 10 out of and away from the waterway 12 system comprises moving the barge 10 up the embankment 80 (FIGS. 3-6). As shown, the barge 10 is raised in a level orientation up the embankment 80 at a rate of about 200 feet per hour. Furthermore, moving the barge 10 away from the refurbishing system 26 comprises lowering, in a level orientation, the barge 10 down the embankment 80 (FIG. 16). Since the barge 10 laterally moves away from the waterway 12, longitudinally moves within the refurbishing system 26 and laterally moves back toward the waterway 12, the barge 10 is raised, moved and lowered in the same axial direction, i.e. in the same orientation. This consistent orientation results in stable movement for the barge 10. In other words, in this embodiment, the barge 10 does not rotate on the rails 72, 72*a*, and 72*b* during handling by the transportation system 24.

The following description will describe in detail the transporting by the first transport system 28, the second transport system 30 and the third transport system 32. The method comprises connecting the first transport system 28 to the top of the second transport system 30 (FIGS. 3 and 4). Once connected, the drive system 36 moves the first transport system 28 and the second transport system 30 to descend along the rails 72 into the inland waterway 12. The rails 72 extend into waterway 12 deep enough to allow stabilizer 70 to pass under the river barge 10. The unpowered river barge 10 floats (under control of a tow boat) onto the first transport system 28, wherein the first transport system 28(s) contacts and supports the unpowered river barge 10 (FIG. 4*a*).

The drive system 36 moves the second transport system 30, the connected first transport system 28 and river barge 10, in a transverse or lateral direction out of the waterway 12 along rails 72 up the embankment 80. (FIGS. 3-6). Accordingly, the river barge 10 moves laterally away from the inland waterway 12. As shown in FIG. 4, the drive system 36 raises the second transport system 30, the connected first transport system 28 and river barge 10 up from the waterway 12, across the embankment 80 and toward the inland position. The configuration of the first transport system 28 and the second transport system 30 raises the river barge 10 in a level orientation across the embankment 80. The stabilizer 70 assists in maintaining the barge 10 on the first transport system 28 in the level orientation. Although the embankment 80 angles between the inland waterway 12 and the inland position, the first transport system 28 and the second transport system 30 raise the river barge 10 in this level orientation. At the inland position at the top of the embankment 80, rails 72*a* align with the wheels 62 of the first transport system 28. The first transport system 28 is then disconnected from the second transport system 30.

The drive system 36 then moves the first transport system 28 and supported river barge 10 away from the disconnected second transport system 30 and toward another inland position on the rails 72*a*.

Near the intersections of rails 72*a* and rails 72*b*, the lift system 38, via the jacks 82, lifts the river barge 10 off of the first transport system 28 to allow the third transport system 32 to travel underneath the raised barge 10 (FIGS. 7-9). As shown in FIG. 9*c*, a small portion of rail 72*a* is removed to allow access to the other rail 72*b*. Once the river barge 10 is properly suspended (FIG. 8*b*), the first transport system 28 moves away from the suspended river barge 10. The lift system 38 then lowers the river barge 10 onto the third transport system 32 so that the third transport system 32, mounted on rails 72*b* perpendicular to the rails 72*a*, supports the river barge 10 (FIG. 9). The third transport system 32 supports the river barge 10 while the first transport system 28 moves away from the river barge 10. If desired, the first transport system 28 then moves toward and connects with the second transport system 30 after disconnecting from the river barge 10, wherein the connected second transport system 30 and first transport system 28 move back toward the inland waterway 12 to pick up another river barge 10. As shown in FIG. 10, the third transport system 32 and the now supported river barge 10 move in a longitudinal direction with respect to the inland waterway 12, toward the refurbishing system 26.

The third transport system 32 continues to move the river barge 10, in the level orientation, within the refurbishing system 26 (FIG. 11). The refurbishing system 26 then processes the river barge 10. After the refurbishing system 26 processes the river barge 10, the third transport system 32 retracts the river barge 10, in a longitudinal direction with respect to the inland waterway 12, out of the refurbishing system 26 and toward post processing area 138 (FIGS. 1 and 2).

The post processing area 138 may be optionally covered. The post processing area 138 includes a work area (not shown) such as elevated decks to allow workers to further refurbish and coat surfaces of the river barge 10 such as the superstructure or coaming. For example, the workers may coat the coaming or may weld the exterior surface 22 while the workers are positioned in the work areas. If so desired, the rail system 34 connects with multiple post processing areas 138 to allow multiple river barges 10 to dry and to allow workers to post process the multiple river barges 10.

In this embodiment, the rail system 34 is configured to move the river barges 10 without having to rotate the barges 10. Additionally, the rail system 34 may include switch tracks (not shown) to allow interchangeability of unprocessed barges 10 and processed barges 10 to move along the rail system 34. The transportation system 24 handles multiple barges 10 to allow simultaneous refurbishing of one barge 10 and post processing of other barges 10. The transportation system 24 handles barges 10 to allow other barges 10 to move to respective locations within the transportation system 24. For example, one refurbished barge 10 is moved to the post processing area 138 to allow an un-refurbished barge 10 access to the refurbishing system 26. As such, the processing areas 138 provide a matrix of spaces to move multiple barges 10 on the transportation system 24.

After drying and any post processing, the third transport system 32 moves the barge 10 back over the jacks 82 of the lift system 38. The jacks 82 move from the retracted position 84 to the extended position 86. In the extended position 86, the jacks 82 lift the river barge 10 off the third transport system 32. The drive system 36 then moves the third transport system 32 away from the suspended river barge 10 and moves the first transport system 28 underneath the suspended river barge 10 via the switch track assembly (FIG. 9*c*). When the drive system 36 properly positions the first transport system 28 underneath the river barge 10, the lift system 38 lowers the jacks 82 to the retracted position 84. In the retracted position 84, the jacks 82 lower the barge 10 onto the first transport system 28. The drive system 36 then moves the first transport system 28 and supported barge 10 toward the second transport system 30 that is positioned on the embankment 80. The first transport system 28 then connects with the second transport system 30. The drive system 36 then lowers the second transport system 30, the connected first transport system 28 and supported river barge 10 from the embankment 80 and back into the inland waterway 12 (FIG. 16).

As shown in FIG. 16, the second transport system 30 laterally moves the barge 10 down the embankment 80 and into the inland waterway 12. Although the embankment 80 angles toward the inland waterway 12, the angle assembly 66 of the second transport system 30 allows the second transport system 30 to lower the barge 10 in the level orientation.

Figure 17:
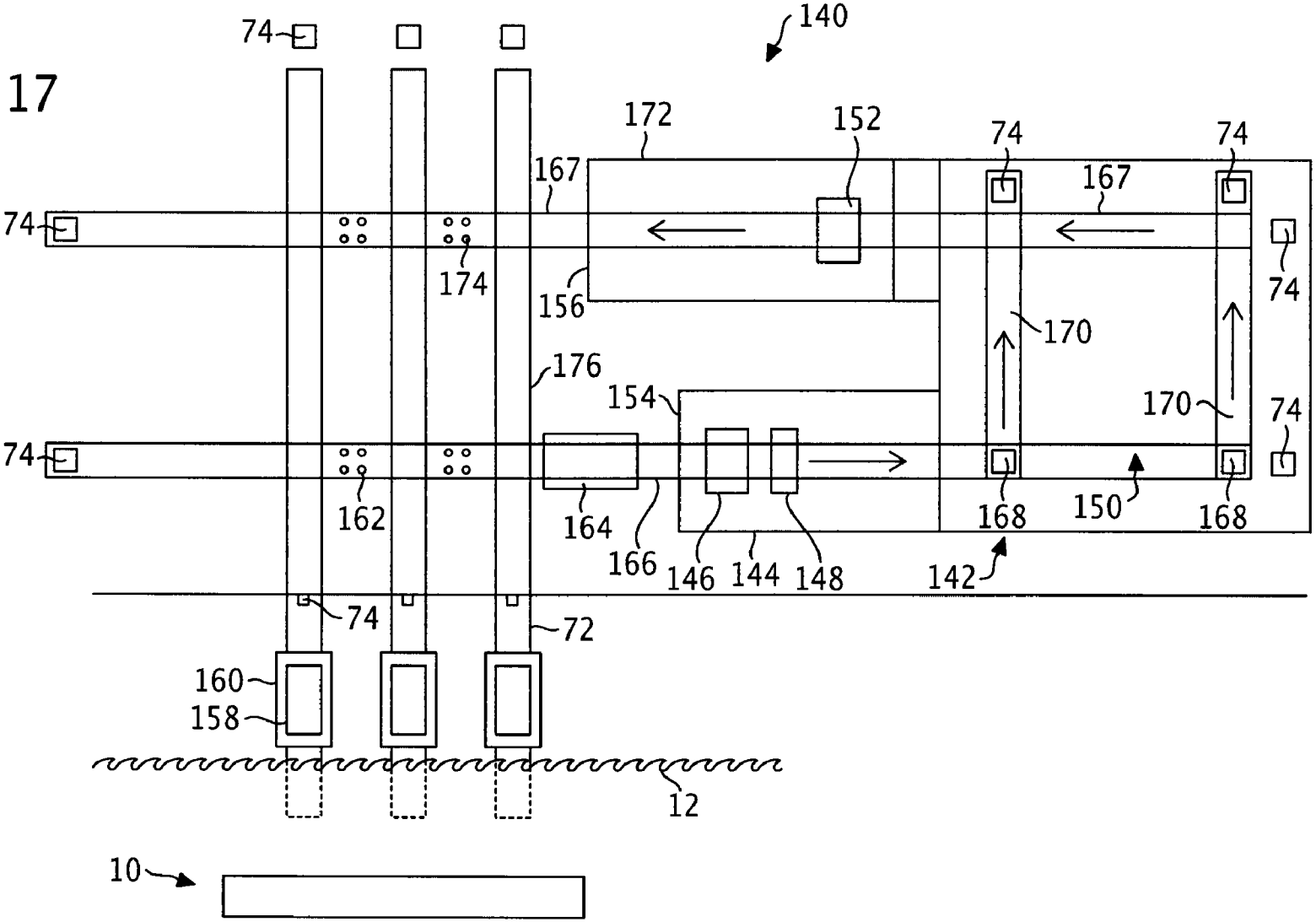
FIG. 17 is a schematic of another embodiment of the present invention illustrating a pass-through system for the transportation system and the refurbishing system.

Referring to FIG. 17, another embodiment of the present invention includes a pass through system generally shown as 140. In this embodiment, the barge 10 is transported and processed within a refurbishing system 142 that comprises a housing 144 which covers a blast system 146, a transition system 148, a transfer system generally shown as 150 and a coating system 152. The housing 144 has an entry end 154 and an exit end 156 as shown. In this embodiment, the blast system 146 and coating system 152 are positioned offset from each other by the transfer system 150. As shown, the refurbishing system 142 comprises a U-shaped configuration. The blast system 146, the transition system 148 and coating system 152 perform the same operation as blast system 50, transition system 52 and coating system 54 respectively.

In this embodiment, the barge 10 is moved in a first direction out of the waterway 12 by a first transport system 158 and a second transport system 160 toward an inland position as previously described. The barge 10 is then moved by the first transport system 158 to lift system 162. The lift system 162 raises the barge 10 to allow third transport system 164 to move under the suspended barge 10. The third transport system 164 moves along rails 166 as shown. The third transport system 164 moves the supported barge 10 in a second direction into the refurbishing system 142. The second direction is perpendicular to the first direction. As shown, the third transport system 164 longitudinally moves the barge 10 within the covered blast system 146. The covered blast system 146 abrasively processes the barge 10 as previously discussed. Subsequent to abrasive blasting, the third transport system 164 moves the barge 10 through the transition system 148 wherein workers can process the barge 10 as previously described.

Figure 17A:
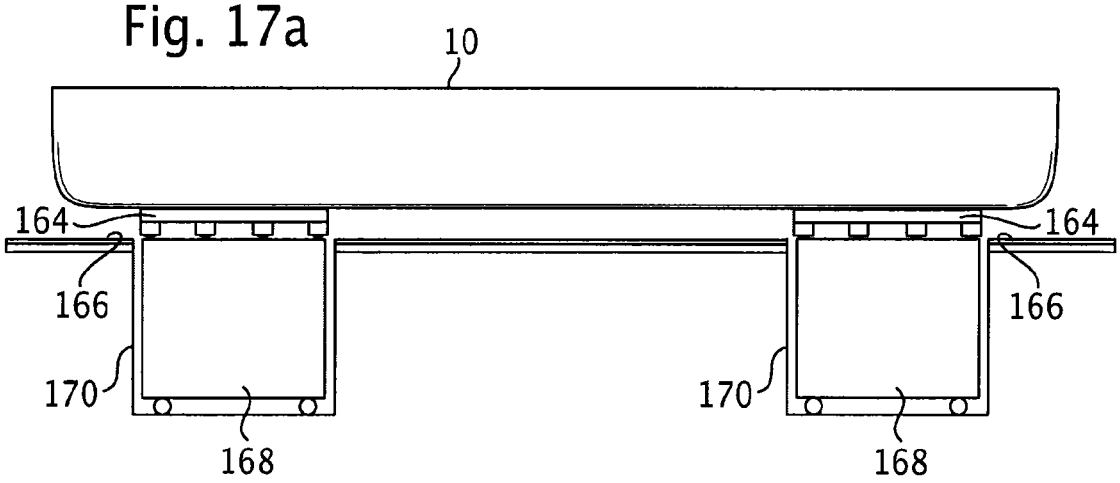
FIG. 17*a* is a cross-sectional view of the third transport systems and supported barge positioned on transfer platforms.

The third transport system 164 then moves the barge 10 into the transfer system 150. As shown in FIG. 17*a*, the transfer system 150 comprises a fourth transport system 168 in the form of wheeled platforms positioned within channels 170. The rails 166 do not extend over the channels 170. Instead, the tops of the platforms 168 are positioned in the same plane as the rails 166. The third transport system 164 moves the barge 10 within the transfer system 150 such that the third transport system 164 moves on top of the platforms 168. Once the third transport systems 164 are properly positioned on top of the platforms 168, the platforms 168 move the third transport system 164 and supported barge 10 in a third direction opposite to the second direction. The platforms 168 move the barge 10 in its same orientation toward rails 167. Rails 167 do not extend over the channels 170 at the opposite ends of the channels 170.

The platforms 168 move the third transport system 164 in alignment with the rails 167. The drive system then drives the third transport system 164 in the direction opposite of the second direction. The third transport system 164 longitudinally moves the barge through the covered coating system 152. The covered coating system 152 processes the barge 10 as previously discussed. After the coating process, the third transport system 168 moves the barge 10 into the drying area 172.

After drying, the third transport system 164 moves the barge 10 to another lift system 174 that is positioned beyond the drying area 172 along rails 176. The other lift system 174 unloads the barge off the third transport system 164 and loads the barge 10 on the first transport system 158 positioned on rails 176. The first transport system 158 then reconnects with the second transport system 160 to lower the barge back into the waterway 12 previously described.

Figure 18:
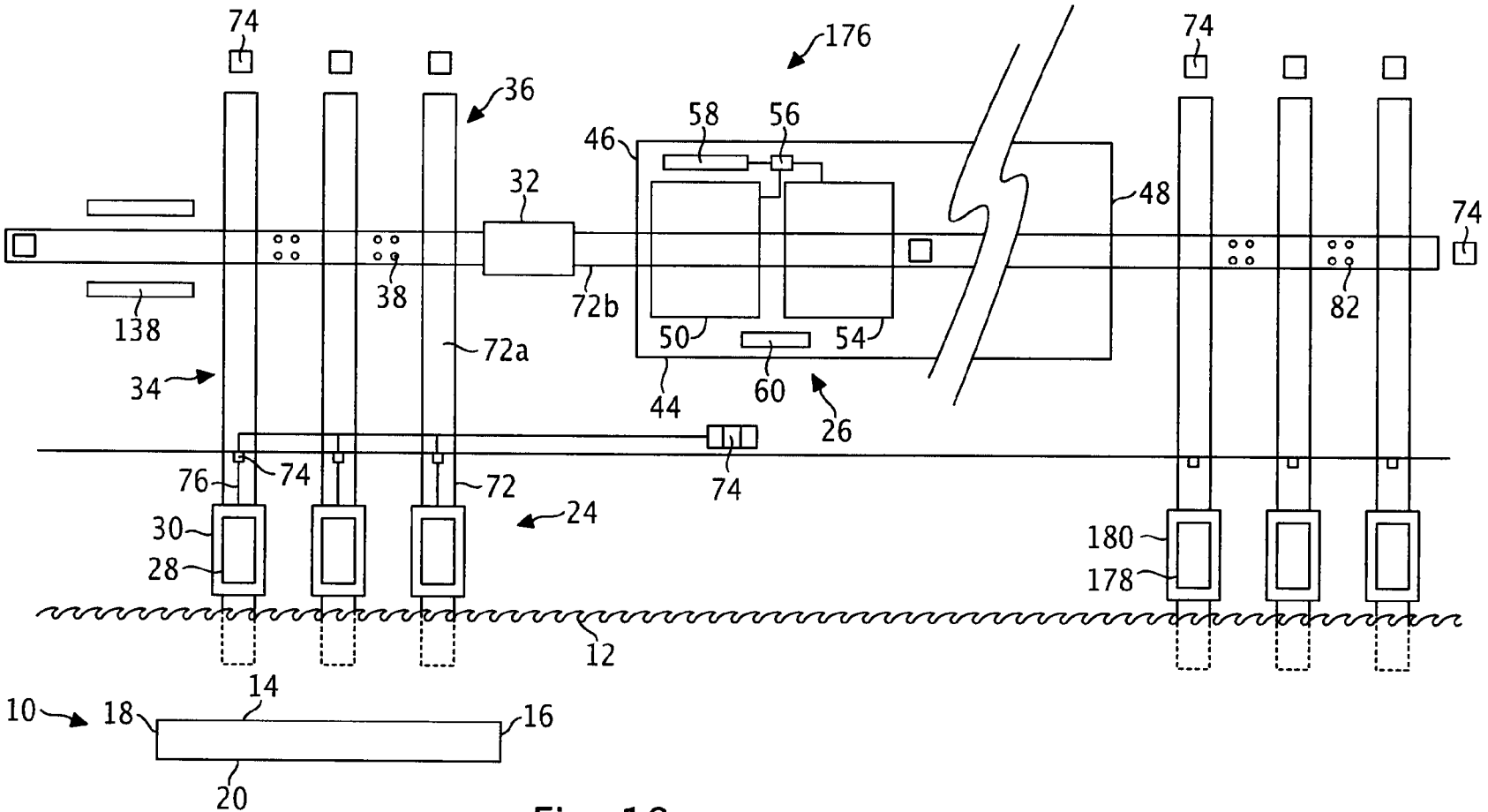
FIG. 18 is a schematic of another embodiment of the present invention illustrating a pass through system for the transportation system and the refurbishing system.

Referring to FIG. 18, another embodiment of the present invention includes another pass through system generally shown as 176. In this embodiment, the barge 10 is transported and processed within the refurbishing system 26 as previously described. After coating the barge 10, the drive system 36 does not retract the third transport system 32 and supported barge 10 out of the first end 46 of the refurbishing system 26. Instead, the drive system 36 moves the barge 10 out of the second end 48 of the housing 44. The third transport system 32 moves the barge 10 longitudinally away from the refurbishing system 26. As such, in this embodiment, the barge 10 enters the first end 46 of the housing 44 and exits the second and 48 of the housing 44.

Upon exiting the second end 48, other jacks 82 (FIG. 18) of the lift system 38 move to the extended position 86 to lift the barge 10 off the third transport system 32. As shown, the other jacks 82 are positioned beyond the second end 48 of the housing 44. While the jacks 82 suspend the barge 10, the drive system 36 moves the third transport system 32 away from the barge 10. Once the third transport system 32 is cleared from the barge 10, the drive system 36 moves the fourth transport system 78 underneath the barge 10.

When the drive system 36 properly positions the fourth transport system 178 underneath the barge 10, the lift system 38 lowers the jacks 82 to the retracted position 84. In the retracted position 84, the jacks 82 lower the barge 10 onto the transport system 178 so that the transport system 178 supports the barge 10.

The drive system 36 then moves the transport system 178 and the supported barge 10 toward the fifth transport system 180. The transport system 178 connects with the fifth transport system 180. The drive system 36 then lowers the fifth transport system 180, the connected transport system 178 and supported barge 10 down the embankment 80 and back into the waterway 12 as previously discussed. At the waterway 12, the barge 10 releases from the transport system 178 and floats free within the inland waterway 12.

In the embodiments of FIGS. 17 and 18, the transport systems and platforms may be driven by the motor driven winches 74 and cables 76 as previously discussed. The platforms may also travel along rails.

Numerous other variations in the present invention, within the scope of the appended claims, will occur to those skilled in the art in light of the foregoing invention. Merely by way of example, the transportation system may be utilized in other ways, for example with other types of refurbishment systems, including different surface preparation systems and different coating systems, and further including refurbishment systems for the interior of the hull of the barge, refurbishment systems for the superstructure, and systems for more major refurbishment, such as replating some or all of the barge hull to repair more major damage or to re-outfit the hull for different uses. Likewise, the abrasive blasting process or the coating process of the invention may be carried out individually without the other process. Either or both of the processes may be carried out in a suitable enclosure using different types of transport systems. Some aspects of the invention may be carried out with a modified dry-dock system, and some may be carried out with a movable abrasive system or a movable coating system for blasting or coating a stationary barge. Furthermore, the control system is configured to time the movement of any particular barge and time the activation of the blast system, the transition system and the coating system, including automated coating systems. Some of the advantages of the present invention may be obtained without the use of an enclosure for the surface preparation and/or the coating processes. These variations are merely illustrative.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A method of refurbishing a barge having a length of about 100-450 feet (about 30 to about 135 meters), a width of about 30-75 feet (about 9 to about 23 meters), and a depth of about 8-30 feet (about 2.5 to about 9 meters), the method comprising:

submerging a transport system into a waterway;

moving the barge over the submerged transport system;

moving the transport system in contact with the barge such that the transport system securely supports the barge;

moving the transport system and barge from the waterway, up an embankment to an on-land position and away from the waterway;

transferring the barge from the transport system to another transport system;

moving the other transport system and barge from the on-land position into a covered blast area;

abrasive blasting an exterior surface of the barge with an abrasive media while the barge is positioned within the covered blast area;

moving the other transport system and barge to a covered coating area; and applying a coating to the exterior surface of the barge while the barge is positioned within the covered coating area.

2. The method of claim 1 further comprising collecting in a pit the abrasive media that has been blasted against the exterior surface of the barge, the pit comprising augers which move the abrasive media, and recycling the collected abrasive media.

3. The method of claim 1 wherein abrasive blasting the exterior surface comprises abrasive blasting sides and bottom of the exterior surface while the barge moves through the covered blast area.

4. The method of claim 1 wherein coating the exterior surface comprises coating sides and bottom of the exterior surface while the barge moves through the covered coating area.

5. The method of claim 1 wherein moving the barge out of the waterway, up the embankment, to the position on land, into the covered blast area comprises moving the barge in the same orientation.

6. The method of claim 1 wherein transferring the barge comprises lifting the barge off of the transport system and lowering the barge onto the other transport system.

7. The method of claim 1 wherein abrasive blasting the barge further comprises controllably moving the other transport system and barge within the covered blast area.

8. The method of claim 1 wherein coating the barge further comprises controllably moving the other transport system and barge within the covered coating area.

9. A refurbishing system for refurbishing a barge, the system, comprising:

a covered blast system having a blast media storage tank which stores abrasive media, the covered blast system further having a blast media discharge system in communication with the blast media storage tank, the blast media discharge system comprising a plurality of blast discharge nozzles which are configured to discharge the abrasive media against an exterior surface of the barge;

a reclamation system in communication with the blast media discharge system, the reclamation system having a collector and a recycler, wherein the collector receives the abrasive media after the abrasive media has been discharged against the exterior surface of the barge and wherein the recycler accepts the collected abrasive media from the collector and moves the collected abrasive media to the blast media storage tank for reuse of the collected abrasive media; and a transportation system, the transportation system having rails and a wheeled platform, the rails being positioned within the covered blast system and positioned under blast discharge nozzles of the plurality of blast discharge nozzles, the wheeled platform being operatively connected to the rails and is configured to move the barge through the covered blast system.

10. The refurbishing system of claim 9 further comprising a control system which automatically controls the wheeled platform and the blast system.

11. The refurbishing system of claim 9 further comprising a covered coating system in communication with the covered blast system, the covered coating system having a coating storage tank which stores an amount of coating and having a coating discharge system in communication with the coating storage tank.

12. The refurbishing system of claim 9 further comprising a covered transition system positioned subsequent the covered blast system, the covered transition system having an air discharge system that discharges compressed air to remove abrasive media that is adhered to the exterior surface of the barge.

13. An refurbishing system for refurbishing a barge having a length of about 100-450 feet (about 30 to about 135 meters), a width of about 30-75 feet (about 9 to about 23 meters), and a depth of about 8-30 feet (about 2.5 to about 9 meters), the system, comprising:

a covered blast area having a blast media storage tank which stores abrasive media, the covered blast area further having a blast media discharge system in communication with the blast media storage tank, the blast media discharge system being configured to discharge the abrasive media against an exterior surface of the barge;

a covered coating area, the covered coating area having a coating storage tank which stores an amount of coating and having a coating discharge system in communication with the coating storage tank, the coating discharge system being configured to discharge the coating onto the blasted exterior surface of the barge; and a transportation system operatively connected with the covered blast area and operatively connected with the covered coating area, the transportation system comprises a first transport system, a second transport system and a third transport system, the first transport system includes a wheeled platform that is configured to contact and to support the barge, the second transport system includes a wheeled frame that is configured to move the first transport system and the barge out and away from a waterway to an on-land position wherein the wheeled platform of the first transport system is configured to further move the barge into the on-land position, the third transport system including another wheeled platform that is configured to move the barge from the first transport system within the covered blast area and within the covered coating area in a level orientation while the blast media discharge system and the coating discharge system respectively process sides and bottom of the exterior surface of the barge.

14. The refurbishing system of claim 13 wherein the transportation system further comprises a drive system that operatively moves the first transport system, the second transport system and the third transport system.

15. The refurbishing system of claim 14 wherein the drive system comprises a plurality of motors, winches and cables wherein the cables connect the plurality of motors to each of the first transport system and the second transport system.

16. The system of claim 15 further comprising a control system which controls the drive system and the blast media discharge system.

17. A method of refurbishing a barge, the method comprising laterally moving the barge from an inland waterway up an embankment to position on-land, and thereafter longitudinally moving the barge into an enclosed abrasive blast area, the blast area comprising a blast media discharge system, producing relative movement between the barge and the blast media discharge system while causing the blast media discharge system to discharge blast media in a predetermined pattern into contact with sides and bottom of the barge, and automatically controlling at least one of the producing relative movement and the causing the blast media discharge system to discharge blast media in a predetermined pattern.

18. A method of refurbishing a barge, the method comprising:

submerging a transport system into a waterway;

moving the barge over the submerged transport system;

moving the transport system in contact with the barge such that the transport system securely supports the barge;

moving the transport system and barge from the waterway, up an embankment to an on-land position and away from the waterway;

moving the transport system and barge from the on-land position into a covered blast area;

abrasive blasting an exterior surface of the barge with an abrasive media while the barge is positioned within the covered blast area; and applying a coating to the exterior surface of the barge.

19. A refurbishing system for refurbishing a barge on land, the system, comprising:

a covered blast system positioned on land, the covered blast system having a blast media storage tank which stores abrasive media, the covered blast system further having a blast media discharge system in communication with the blast media storage tank, the blast media discharge system comprising a plurality of blast discharge nozzles;

a transportation system having rails, the rails being positioned within the covered blast system and positioned under blast discharge nozzles of the plurality of blast discharge nozzles, the transportation system being configured to move the barge into the covered blast system wherein the plurality of blast discharge nozzles discharge the abrasive media against an exterior surface of the barge; and a reclamation system in communication with the blast media discharge system, the reclamation system having a collector and a recycler, wherein the collector receives the abrasive media after the abrasive media has been discharged against the exterior surface of the barge and wherein the recycler accepts the collected abrasive media from the collector and moves the collected abrasive media to the blast media storage tank for reuse of the collected abrasive media.

* * * * *